US009366503B2

(12) United States Patent
Schmidt et al.

(10) Patent No.: US 9,366,503 B2
(45) Date of Patent: Jun. 14, 2016

(54) GUNSHOT DETECTION STABILIZED TURRET ROBOT

(75) Inventors: Mads Schmidt, Cambridge, MA (US); Arnis Mangolds, Stow, MA (US); Michael Rufo, Abington, MA (US); James Murray, Canton, MA (US)

(73) Assignee: Foster-Miller, Inc., Waltham, MA (US)

( * ) Notice: Subject to any disclaimer, the term of this patent is extended or adjusted under 35 U.S.C. 154(b) by 723 days.

(21) Appl. No.: 12/384,590

(22) Filed: Apr. 7, 2009

(65) Prior Publication Data

US 2009/0281660 A1 Nov. 12, 2009

Related U.S. Application Data

(60) Provisional application No. 61/123,299, filed on Apr. 7, 2008.

(51) Int. Cl.

| | |
|---|---|
| ***F41A 23/24*** | (2006.01) |
| ***F41H 11/06*** | (2006.01) |
| ***F41H 13/00*** | (2006.01) |
| ***F41G 3/14*** | (2006.01) |

(52) U.S. Cl.

CPC ..... *F41G 3/147* (2013.01); *F41A 23/24* (2013.01); *F41H 11/06* (2013.01); *F41H 13/00* (2013.01)

(58) Field of Classification Search

None

See application file for complete search history.

(56) References Cited

U.S. PATENT DOCUMENTS

| | | | | |
|---|---|---|---|---|
| 4,316,218 | A * | 2/1982 | Gay | 348/169 |
| 4,386,848 | A * | 6/1983 | Clendenin et al. | 356/5.01 |
| 4,514,621 | A | 4/1985 | Knight et al. | |
| 5,123,327 | A * | 6/1992 | Alston et al. | 89/1.813 |
| 5,241,518 | A | 8/1993 | McNelis et al. | |
| 5,586,086 | A | 12/1996 | Permuy et al. | |
| 5,917,775 | A | 6/1999 | Salisbury | |
| 6,467,388 | B1 * | 10/2002 | Malakatas | 89/41.03 |
| 6,535,793 | B2 * | 3/2003 | Allard | 700/259 |
| 6,701,821 | B2 * | 3/2004 | Lundqvist et al. | 89/37.03 |
| 6,847,587 | B2 | 1/2005 | Patterson et al. | |
| 6,999,881 | B2 | 2/2006 | Permuy et al. | |
| 7,121,142 | B2 | 10/2006 | Chevret et al. | |
| 7,139,222 | B1 | 11/2006 | Baxter et al. | |
| 7,210,392 | B2 * | 5/2007 | Greene et al. | 89/41.03 |
| 7,584,045 | B2 * | 9/2009 | Peretz | 701/117 |
| 7,600,462 | B2 * | 10/2009 | Quinn | 89/41.08 |
| 7,650,826 | B2 * | 1/2010 | Son et al. | 89/27.3 |
| 7,654,348 | B2 * | 2/2010 | Ohm et al. | 180/9.32 |

(Continued)

OTHER PUBLICATIONS

Thoren_RedOwl.pdf (Dr. Glenn Thoren, From Hollywood to Homes (and to Defense and Security): Robots for Today the RedOwl Project, Boston University, Mar. 31, 2006, 24 pages).*

(Continued)

*Primary Examiner* — Bao Long T Nguyen

(74) *Attorney, Agent, or Firm* — Iandiorio Teska & Coleman, LLP

(57) ABSTRACT

A mobile, remotely controlled robot comprising a robot drive subsystem for maneuvering the robot, a turret on the robot, a turret drive for moving the turret, a noise detection subsystem for detecting the probable origin of a noise, a robot position and movement sensor subsystem, a turret position sensor subsystem, and one or more processors, responsive to the noise detection subsystem, the robot position and movement sensor subsystem. The turret position sensor subsystem is configured to control the turret drive to orient the turret to aim a device mounted thereto at the origin of the noise and to maintain said aim as the robot moves.

8 Claims, 21 Drawing Sheets

(56) References Cited

U.S. PATENT DOCUMENTS

| | | | | |
|---|---|---|---|---|
| 7,962,243 | B2 | 6/2011 | DeGuire et al. | |
| 7,974,738 | B2 * | 7/2011 | Bruemmer et al. | 700/255 |
| 2004/0068415 | A1 * | 4/2004 | Solomon | 705/1 |
| 2006/0149541 | A1 | 7/2006 | Jaklitsch et al. | |
| 2006/0271263 | A1 * | 11/2006 | Self et al. | 701/50 |
| 2007/0057842 | A1 | 3/2007 | Coleman et al. | |
| 2008/0063400 | A1 * | 3/2008 | Hudson et al. | 398/106 |
| 2008/0071480 | A1 * | 3/2008 | Lin | 702/35 |
| 2008/0083344 | A1 | 4/2008 | Deguire et al. | |
| 2008/0121097 | A1 * | 5/2008 | Rudakevych et al. | 89/28.05 |
| 2009/0164045 | A1 | 6/2009 | Deguire et al. | |
| 2010/0212482 | A1 | 8/2010 | Morin et al. | |
| 2010/0263524 | A1 | 10/2010 | Morin et al. | |
| 2011/0005847 | A1 | 1/2011 | Andrus et al. | |

OTHER PUBLICATIONS www.defensereview.com_anti-snipersniper-detectiongunfire-detection-systems-at-a-glance.pdf (David Crane Anti-Sniper/Sniper Detection/Gunfire Detection Systems at a glance, Defense Review, published Jul. 19, 2006, pp. 1-7, cache on Google on Oct. 17, 2011).*

* cited by examiner

GUNSHOT DETECTION STABILIZED TURRET ROBOT

RELATED APPLICATIONS

This application hereby claims the benefit of and priority to U.S. Provisional Application No. 61/123,299, filed Apr. 7, 2008, under 35 U.S.C. §§119, 120, 363, 365, and 37 C.F.R. §1.55 and §1.78, incorporated by reference herein.

This invention was made with U.S. Government support under Contract No. W15QKN-04-C-1013 awarded by the U.S. Army. The Government may have certain rights in the invention.

FIELD OF THE INVENTION

This subject invention relates to mobile, remotely controlled robots, and weaponized robots.

BACKGROUND OF THE INVENTION

Mobile, remotely controlled robots are often equipped with new technologies and engineered to carry out some missions in a more autonomous manner.

iRobot, Inc. (Burlington, Mass.) and the Boston University Photonics Center (Boston, Mass.), for example, demonstrated a robot equipped with sensors that detect a gunshot. The robot head, upon detection of a shot, swiveled and aimed two clusters of bright-white LEDs at the source of the shot. See "Anti-Sniper/Sniper Detection/Gunfire Detection System at a Glance", by David Crane, defensereview.com, 2005, incorporated herein by this reference. See also U.S. Pat. Nos. and Published Patent Applications Nos. 5,241,518; 7,121,142; 6,999,881; 5,586,086; 7,139,222; 6,847,587; 5,917,775; 4,514,621; and 2006/0149541, all of which incorporated herein by this reference.

The assignee hereof has devised a robot with a weapon which can be fired by the operator controlling the weapon. See, e.g., U.S. patent application Ser. No. 11/543,427 entitled "Safe And Arm System For A Robot", filed on Oct. 5, 2006, incorporated by reference herein. The following co-pending patent applications by the assignee of the applicants hereof are hereby incorporated by this reference: U.S. patent application Ser. Nos. 12/316,311, filed Dec. 11, 2008; 11/543,427 filed Oct. 5, 2006; 11/732, 875 filed Apr. 5, 2007; 11/787,845 filed Apr. 18, 2007; and 12/004,173 filed Dec. 19, 2007.

The inventors have discovered that its robots, when deployed in hostile environments, are often fired upon. Therefore, it is insufficient for the robot to merely detect a gunshot or other sound. Instead, the robot must be capable of detecting a gunshot, targeting the origin of the gunshot, maneuvering, and maintaining the targeted origin as the robot moves. Requiring an operator controlling the robot to maintain the target origin while maneuvering the robot significantly increases the workload requirements of the operator.

BRIEF SUMMARY OF THE INVENTION

It is therefore an object of this invention to provide a robot which can both pinpoint the origin of a sound, such as a gunshot, and also maneuver while targeting the origin.

It is a further object of this invention to provide such a robot which is less likely to suffer damage from unfriendly fire.

It is a further object of this invention to provide such a robot which can return fire.

It is a further object of this invention to provide such a robot which reduces the work load requirements faced by the robot operator.

The subject invention results from the realization that a new robot which pinpoints the origin of a sound, such as a gunshot or similar type sound, aims a device, such as a weapon, at the origin of the sound, and maneuvers and maintains the aim of the device at the origin while maneuvering is effected by a turret on the robot in combination with a turret drive, a set of sensors, and processing electronics which control the turret drive to orient the turret to aim a device, such as a weapon mounted to the turret, at the origin of the sound and to maintain the aim as the robot moves.

The subject invention, however, in other embodiments, need not achieve all these objectives and the claims hereof should not be limited to structures or methods capable of achieving these objectives.

This invention features a mobile, remotely controlled robot including a robot drive subsystem for maneuvering the robot, a turret on the robot, and a turret drive for moving the turret. A noise detection subsystem detects the probable origin of a noise. The robot includes a robot position and movement sensor subsystem, and a turret position sensor subsystem. One or more processors are responsive to the noise detection subsystem, the robot position and movement sensor subsystem, and the turret position sensor subsystem and are configured to control the turret drive to orient the turret to aim a device mounted thereto at the origin of the noise and to maintain said aim as the robot moves.

In one embodiment, the noise detection subsystem may include a gunshot detection subsystem configured to detect the origin of a gunshot and to provide the coordinates of the origin to the one or more processors. An initiation subsystem may activate a device may be mounted to the turret and the one or more processors may be configured to provide an output to the initiation subsystem to activate the device upon receiving a signal from the detection subsystem. The device mounted to the turret may include a source of illumination, a lamp, or a laser. The device mounted to the turret and may include a weapon. The system may include a weapon fire control subsystem for firing the weapon. The system may include an operator control unit for remotely controlling the robot. The one or more processors may include a central processing unit responsive to the noise detection subsystem, the robot position and movement sensor subsystem, and the turret position sensor subsystem configured to calculate the movement of the turret required to keep the device aimed at the origin of the noise, and a turret drive controller responsive to the central processing unit and configured to control the turret drive. A turret drive controller responsive to the robot position and movement sensor subsystem and may be configured to control the turret drive between updates provided by the one or more processors. The robot position and movement sensor subsystem may include a GPS receiver and motion sensors. The turret drive may include motors for rotating and elevating the turret. The turret position sensor subsystem may include encoders. The processing electronics may include one or more of a GPS receiver, a rate gyro, a fiber optic gyro, a 3-axis gyro, a single axis gyro, a motion controller, and an orientation sensor. The system may include a directional communication subsystem for providing communication between the operator control unit and the robot.

The subject invention also features a mobile, remotely controlled gunshot detection stabilized turret robot including a robot drive subsystem for maneuvering the robot, a turret on the robot, and a turret drive for moving the turret. A gunshot detection subsystem detects the origin of a gunshot and provides the coordinates thereof. The robot includes a robot position and movement sensor subsystem, and a turret position sensor subsystem. One or more processors are responsive to the noise detection subsystem, the robot position and movement sensor subsystem, and the turret position sensor subsystem and are configured to control the turret drive to orient the turret to aim a device mounted thereto at the origin of the noise and to maintain said aim as the robot moves.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
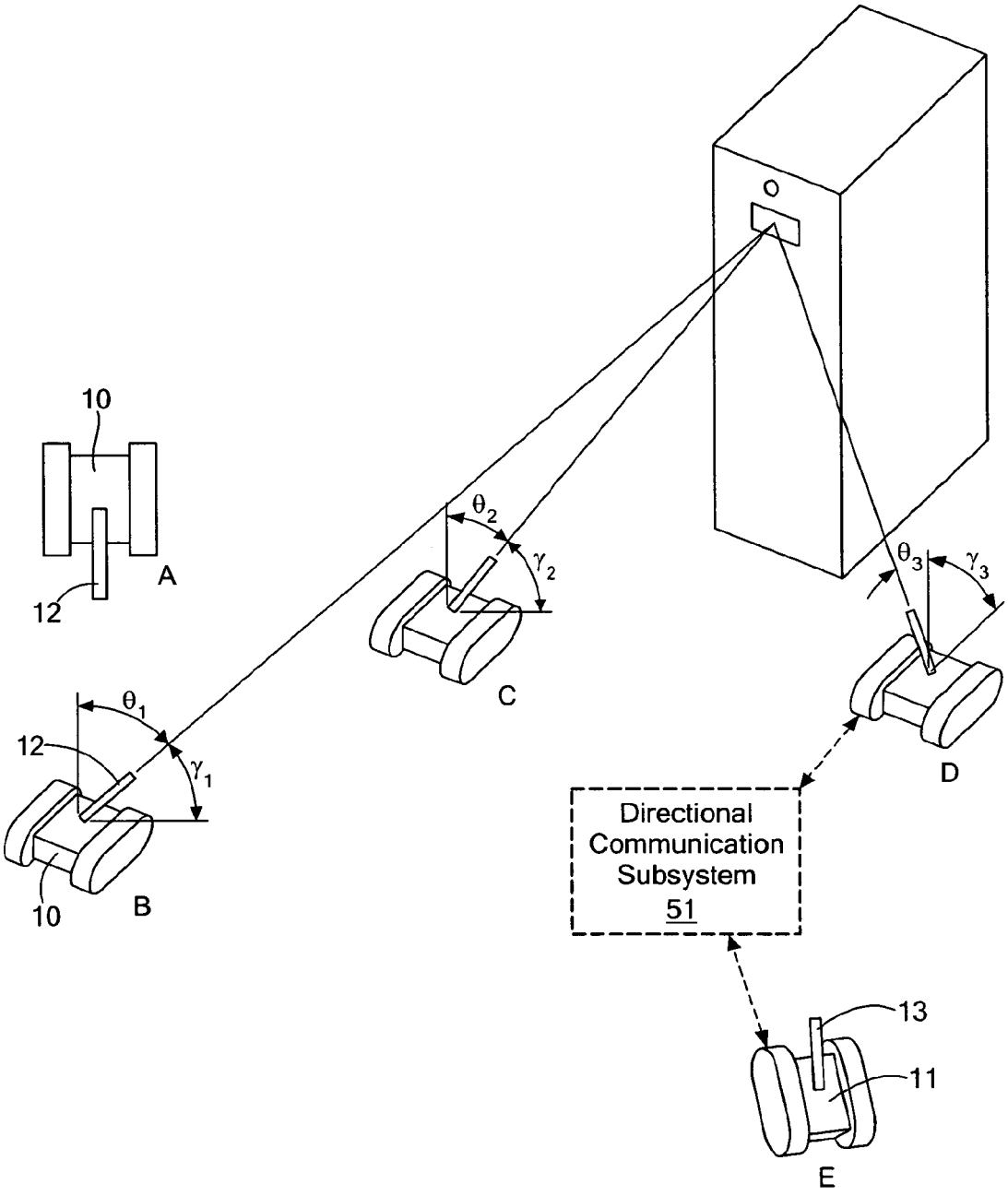
FIG. 1 is a schematic three-dimensional view showing an example of the operation of a robot in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows one embodiment of robot 10 with device 12, e.g., a weapon, laser or similar type device in accordance with this invention. In this example, robot 10 is at position A when a gunshot or similar type noise is detected at location O-13. Robot 10 is maneuvering and at position B weapon 12 is rotated to angle $\gamma_1$ and elevated to angle $\theta_1$ to aim the weapon at location O-13. Still maneuvering, robot 10 at position C has maintained the aim of weapon 12 at location O-13 by rotating weapon 12 to angle $\gamma_2$ and increasing the elevation to $\theta_2$. At position D, weapon 12 is now at rotation angle $\gamma_3$ and at elevation $\theta_3$.

In this way, robot 10 of this invention not only detects the origin of a gunshot or similar type sound and aims weapon 12 at the origin of the sound, robot 10 also maintains the aim at the origin of sound as robot 10 maneuvers. This allows a user, when maneuvering robot 10 from position C to D, for example, to fire weapon 12 to location of the origin of the sound. Because robot 10 continues to maneuver while weapon 12 is aimed at location of the origin of the sound, e.g., O-13, the likelihood that robot 10 will be damaged by fire from that location is reduced and robot 10 can then continue on its mission. Robot 10 can fire upon the location of the origin of the sound automatically or under the control of an operator. Further, robot 10 can communicate wirelessly with robot 11 at location E and provide robot 11 with data concerning location of the origin of the sound so robot 11 can aim its weapon 13 at that location.

Figure 2:
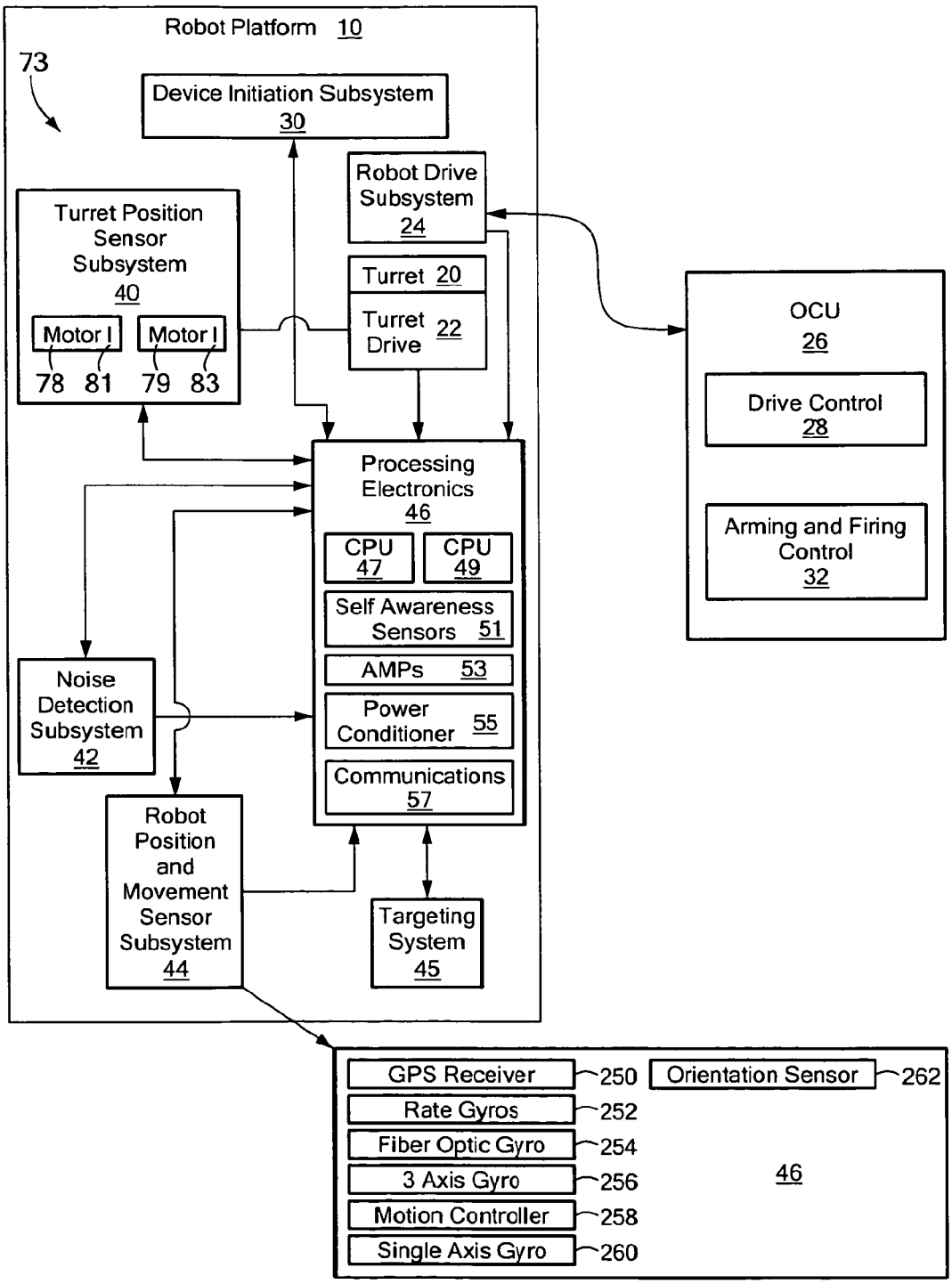
FIG. 2 is a schematic block diagram showing the primary components associated with one example of a robot shown in FIG. 1 in accordance with the subject invention.

One example of the primary subsystems associated with a robot 10 is shown in FIG. 2. Robot 10 is preferably a TALON® or Swords robot (Foster-Miller, Inc., Waltham, Mass.). See, e.g., U.S. patent application Ser. Nos. 11/543,427 and 12/316,311, filed Dec. 11, 2008; 11/543,427 filed Oct. 5, 2006; 11/732,875 filed Apr. 5, 2007; 11/787,845 filed Apr. 18, 2007; and 12/004,173 filed Dec. 19, 2007, cited supra, and incorporated by reference herein. Other robot platforms, however, are possible. Robot 10 includes robot drive subsystem 24 having motors and tracks and/or wheels which maneuver the robot and are typically wirelessly controlled by operator control unit (OCU) 26 with drive control 28, as known in the art. Robot 10 is also equipped with a turret 20 and turret drive 22, e.g., turret 20, FIG. 3, and turret drive train 22, discussed in further detail below. Different types of devices can be placed in turret 20, such as a weapon 50, FIG. 4, e.g., an M16/M14, M249, or multiple M203 machine gun, or similar type weapon, or an illuminator, such as a lamp, LEDs, a laser, and the like. In operation, the weapon is fired, or the device is operated, by initiation subsystem 30, FIG. 2, either automatically or under the control of arming and fire control subsystem 32 of OCU 26.

Turret 20 is preferably rotatable and configured to elevate the device mounted thereto under the control of turret drive 22. Turret position sensor subsystem 40 detects, e.g., using encoders, inclinometers, and the like, discussed in detail below, and outputs the position of the turret and the device (e.g., angles θ and γ, FIG. 1). Noise detection subsystem 42, e.g., gunshot detection subsystem, detects the location of a gunshot or similar type noise and outputs data corresponding to the location of source of origin of that noise, e.g., O-13, FIG. 1, and GPS data, such as elevation, longitude, and latitude, and the like. One preferred gunshot detection subsystem is provided by Planning Systems, Inc. (Reston, Va.). Other gunshot and/or sound detection subsystems are also possible. Other types of sensors are also possible. See e.g., "Anti-Sniper/Sniper Detection/Gunfire Detection System at a Glance", by David Crane, defensereview.com, 2005, incorporated by reference herein. See also, e.g., U.S. Pat. Nos. and Published Patent Applications Nos. 5,241,518; 7,121,142; 6,999,881; 5,586,086; 7,139,222; 6,847,587; 5,917,775; 4,514,621; and 2006/0149541, cited supra, and incorporated by reference herein.

The position of the robot, e.g., robot 10 at positions A-D, FIG. 1, is determined by robot position and movement sensor subsystem 44 disclosed in further detail below.

Processing electronics subsystem 46 preferably includes one or more processors, e.g., CPU 47, and/or CPU 49. Processing electronics subsystem 46 is responsive to the outputs of noise detection subsystem 42, robot position and movement sensor subsystem 44, and turret position sensor subsystem 40 and is configured to control turret drive 22 to orient turret 20 and aim a device mounted thereto at the origin of the gunshot or similar type noise and to maintain that aim as robot 10 maneuvers. Subsystem 46 can be configured, upon receipt of a signal from noise detection subsystem 42, to signal device initiation subsystem 30 to activate a device mounted to turret 20. In this way, a laser, for example, is automatically turned on and aimed at a target. Or, a weapon can be aimed and then automatically fired.

Preferably, processing electronics 46, turret drive 22, turret 20, and turret position sensor subsystem 40 are all integrated in a single modular unit.

Figure 3:
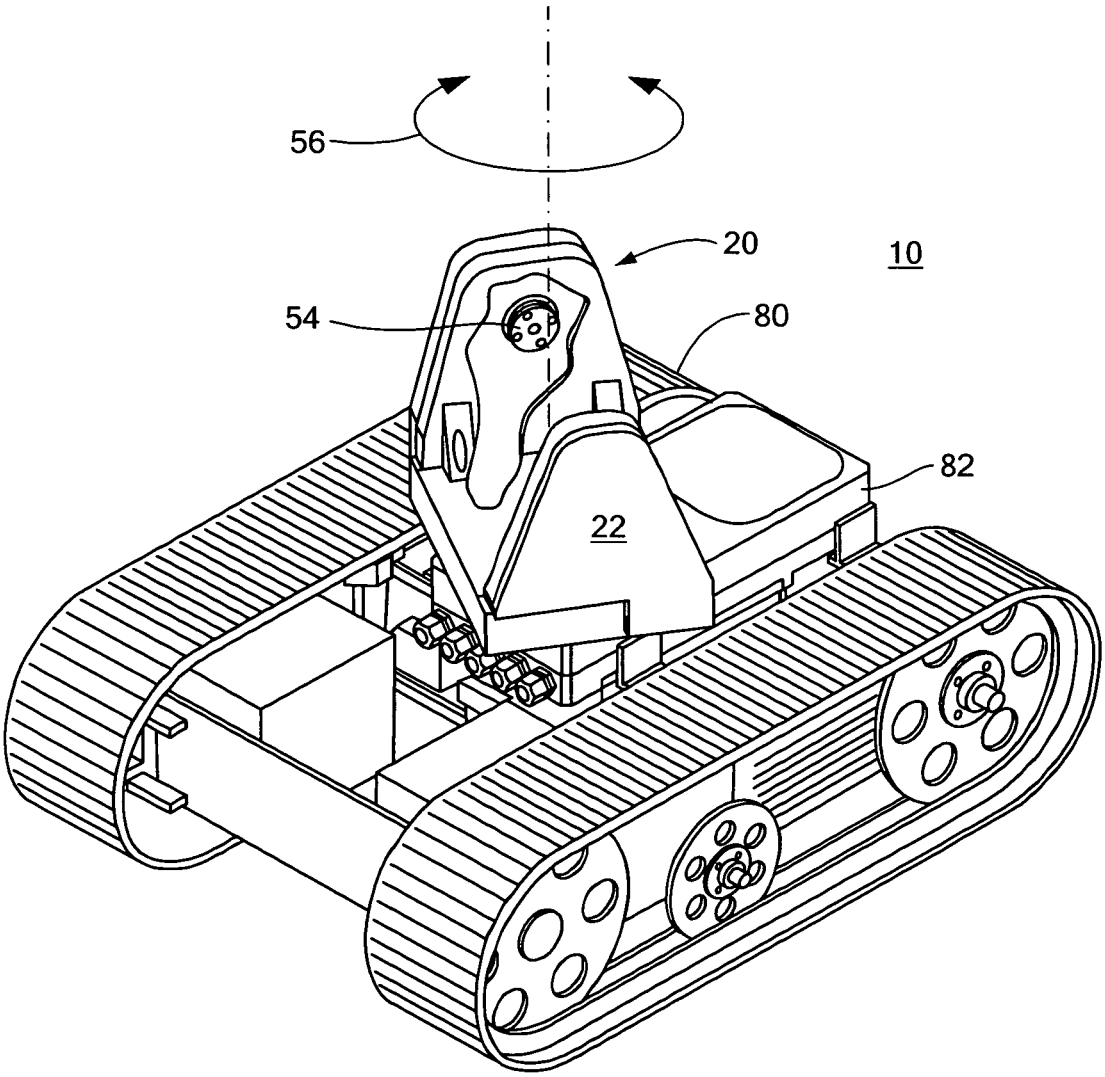
FIG. 3 is a schematic three-dimensional front view showing the robot of this invention equipped with a stabilized turret.
Figure 4:
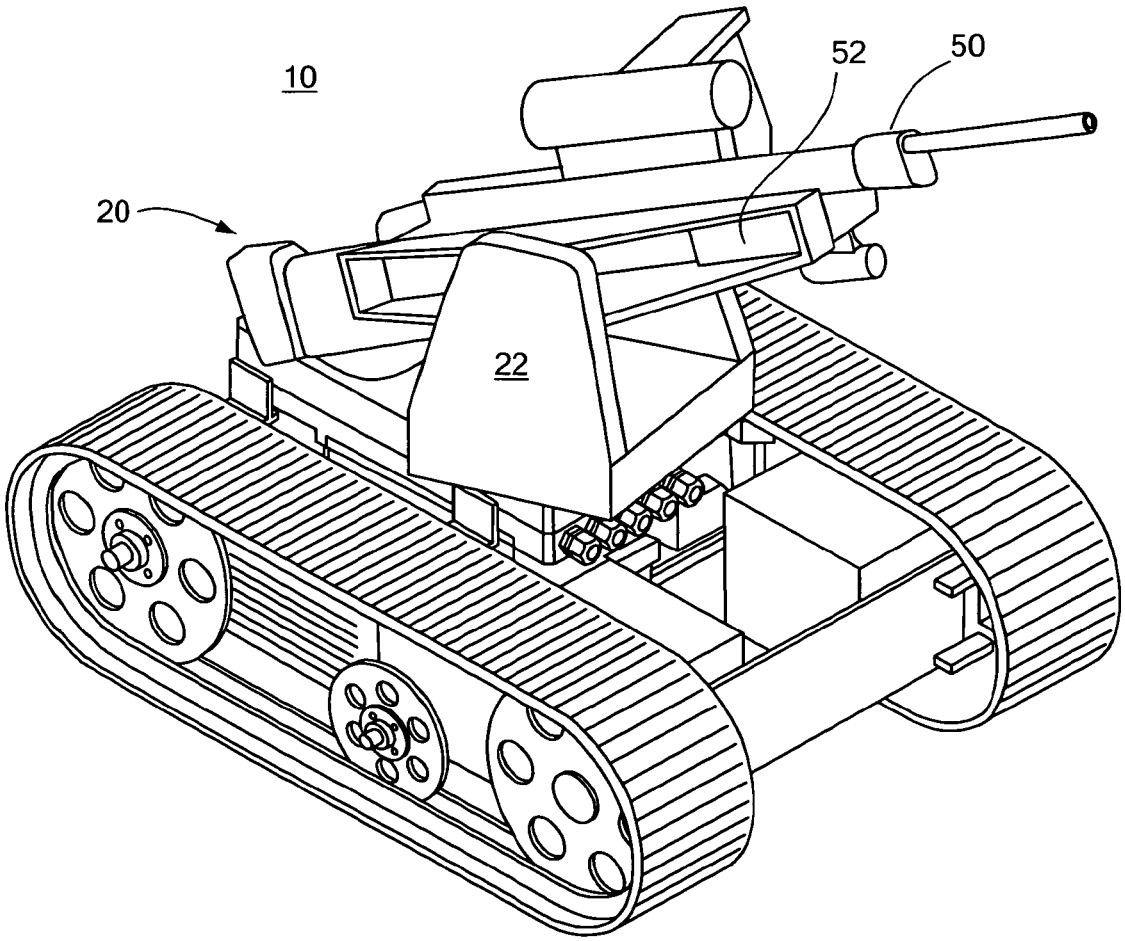
FIG. 4 is a schematic three-dimensional front view showing a weapon mounted in the turret shown in FIG. 3.

FIG. 3 shows one example of a robot 10 with turret 20 rotatable in the direction of arrow 56. Pivot 54 rotates as well to elevate weapon 50, FIG. 4 and/or mount 52 for weapon 50.

The subject invention brings together several capabilities that have not previously been integrated into a single ground system for use in the real world. These capabilities include a proven unmanned ground vehicle or robot capable of operating in tactically significant environments, a tightly integrated 360° turret and elevation axis capable of carrying payloads up to 30 lb, a stabilized weapon/payload turret on the robot, the ability to maintain weapon/payload pointed at the point of origin of a gunshot or similar sound at all times, the ability to autonomously navigate using a sensor fused robotic vehicle state estimate based on GPS, robotic vehicle orientation, rates of motion, and odometry, and an overhead map vehicle location feedback and waypoint and target input. Robot 10 automates tasks that would otherwise completely consume the attention of the operator. Using robot 10, the operator can act more as a commander than a driver or gunner. The operator can command robot 10 to proceed along a path to a specified location while maintaining the weapon/payload pointed at the location of the origin of the gunshot or similar sound. This level of automation of the basic robot tasks of robot 10 allows a single user to operate multiple robots 10.

The turret 20 is preferably designed for interfacing with a small, highly mobile robotic vehicle, e.g., robot 10, FIGS. 1-4, and the robot disclosed in corresponding U.S. patent application Ser. Nos. 11/543,427, 12/316,311, filed Dec. 11, 2008; 11/543,427 filed Oct. 5, 2006; 11/732,875 filed Apr. 5, 2007; 11/787, 845 filed Apr. 18, 2007; and 12/004,173 filed Dec. 19, 2007, cited supra. The slew and pitch rates experienced by robot 10 are higher than those achievable on manned land vehicles or larger robotic vehicles.

Robot 10 of this invention may stabilize the payload in one of several ways: gyro stabilization, stabilization about a heading and an elevation, or stabilization about a GPS coordinate. In gyro stabilization mode, turret 20, FIGS. 2-4, counteracts any motion of the payload. In heading/elevation stabilization mode, turret 20 points the payload along a given heading and a given elevation. In GPS coordinate stabilization, turret 20 points the payload at a given location in space, e.g., the origin of a sound, such as origin O-13, FIG. 1, and maintains the payload pointed at that location even when the vehicle is moving.

Robot 10 is ideally suited for carrying small payload into rapidly changing and hostile environments. Turret 20 is preferably designed to be capable of >180°/s slew rates, allowing the payload pointing direction to be changed rapidly. Camera systems can be slewed to observe a threat, reducing the chance of robot 10 being taken by surprise. Small weapon systems can be slewed rapidly, keeping enemy forces or bystanders in urban combat scenarios away from robot 10.

As a reconnaissance platform, robot 10 of invention can be used in either leading or supporting roles. Robot 10 can be driven out in front of the combat unit by the operator. In the reconnaissance role, robot 10 may include high powered zoom cameras, FLIR cameras, or directional audio sensors. Robot 10 can be used to clear a room prior to entry by the squad. Robot 10 may be outfitted with flash-bangs or non-lethal weapons to allow it to engage an enemy in a less-than-lethal manner.

The commander of robot 10 may have a target designator in the form of either an encoded laser, a range finder, or laser pointer. The operator can drive robot 10 into a hostile area and using high powered zoom cameras and FLIR systems can designate targets for the human element of the squad to engage. Sniper detection is one example of such a mission. Robot 10 may be driven into an open or danger area and the operator uses the sensors mounted thereto to seek and detect enemy snipers. When a sniper is detected, an infrared laser pointer is used to mark the location of the sniper. The troops can use night vision goggles to detect the location of the laser dot and can engage the target location as they see fit.

In the automated response role, robot 10 may be either a sentinel with motion detection systems or robot 10 may use a threat recognition/localization subsystem to home in on the enemy autonomously. In the sentinel role, robot 10 may be parked outside a perimeter. When the motion detection system recognizes an incoming threat, the turret will swing a response payload toward the target and either engage or alert the operator.

A sniper detection system may be mounted on the turret. When a shot is detected and localized, the turret can swing a camera or a weapon in the direction of the sniper, and can either engage the area or alert the operator. If a shot is detected, the turret would swing a camera payload to observe the sniper location, providing an immediate image to the passenger in the vehicle of the sniper's location.

Robot 10 may also be designed to point the payload at a certain location in space. A long range radio link may be established between two robot 10 and robot 11 by putting YAGI style antennas on the turret and having those turrets remain pointed at each other. Each robot sends its location to the other, e.g., robot 10, FIG. 1, to robot 11, allowing the robots to maintain their YAGI pointing direction, regardless of vehicle movement.

In one embodiment, directional communication subsystem 51, maintains a link automatically between robot 10 and robot 11, without human intervention. The chance of interception of the communications is drastically reduced due to the directionality of the link. Anyone outside the projection cone will not be able to eavesdrop on the link.

Multi-robot systems, e.g., such as those which employ robots of this invention, will likely play a critical role in tomorrow's battlefield. Squads of robots may be deployed to engage an enemy or perform reconnaissance. These robots must have exceptional self awareness and awareness of the whereabouts of the rest of the team. They must be able to engage targets designated by the commander vehicle (as described above) in a rapid and fluid way.

Directional communication subsystem 51, FIG. 1, allows the robots, e.g., robots 10, 11, to know where they are with respect to each other. The navigation capabilities allow the operator to deploy and maneuver the robots from a supervisory role, rather than needing to control each robot's moves. The pointing capability allow the robots to "look" where other robots are looking and to maintain payloads or weapons trained on an enemy location while the vehicles are maneuvered into place.

Figure 5:
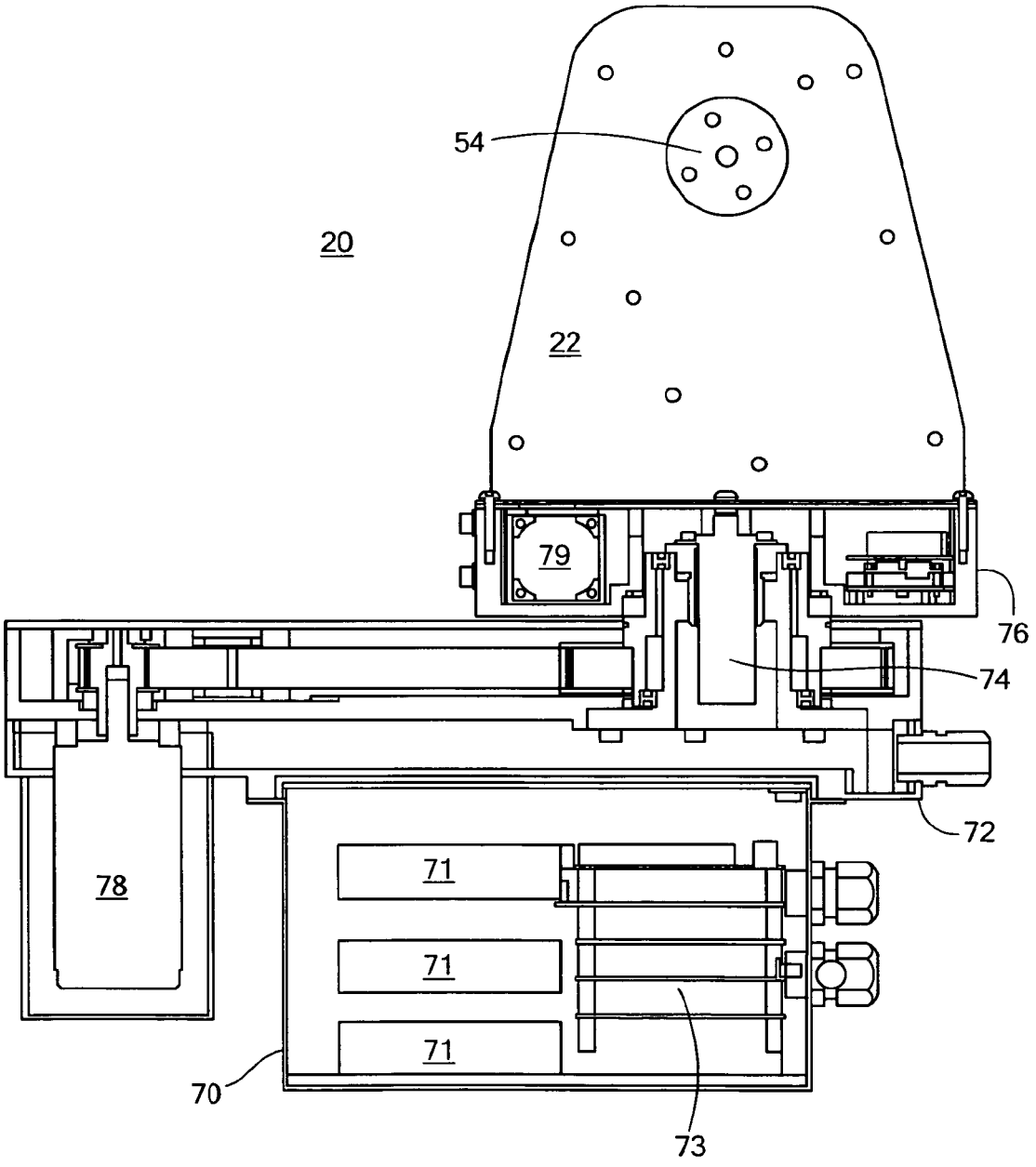
FIG. 5 is a schematic cross-sectional view of one example of the turret shown in FIGS. 2-4.

In one design, turret 20, FIG. 5, and turret drive system 22, may include main (Lower) electronics box 70. Electronics box 70 typically houses interface boards 71 and PC-104 stack 73, typically including processing electronics 46, FIG. 2, with CPU 47, and one or more of the various subsystems shown in FIG. 2. Middle electronics box 72, FIG. 5 typically routes the wires in the electronics box 70 to slipring 74. Upper electronics box 76 preferably contains rotating-frame electronics, such as GPS receivers, elevation motor 79, and the like, discussed below. Turret drive 22 also includes azimuth motor 78 and elevation motor 79. Azimuth motor 78 is preferably contained as low as possible in the design to maintain a low vehicle center of gravity. The payload interface 80, FIG. 3, typically includes a bolt pattern, e.g., bolt 54 to which a payload cradle can be mounted and a series of connectors for powering and communicating with the payload. Preferably, turret drive system 20 is modular for adaptability to provide for payloads and various platforms.

Turret 20, FIGS. 1-5, ideally provides about 180°/sec slew and elevation rate, about 5° pointing accuracy during dynamic maneuvers, e.g., about <0.01° pointing resolution, and about 360° continuous azimuth rotation. Turret 20 is preferably capable of 110°/s slew rates, and pitch rates on the same order. For proper stabilization, turret 20 therefore is ideally capable of at least 110°/s azimuth and elevation rates.

As robot 10 is turning, the aimpoint may change, requiring turret 20 and weapon or other device attached thereto to slew even faster than the robot slew. In one example, turret drive 22 provides about 200°/s to provide about 90°/s turret motion in the direction opposite the slew direction of robot 10. This maximum slew rate allows robot 10 to achieve any new aimpoint within 2 seconds regardless of vehicle motion. In one example, a 5° accuracy is a preferred accuracy with which turret 20 can maintain a payload pointed at a target location. The dynamic accuracy of 5° ensures that turret 20 can maintain a target within the middle third of the field of view of, e.g., a 30° FOV camera or within the beam-width of a YAGI directional antenna.

In one example, the pointing resolution is less than about <0.01° may be used to ensure that the aimpoint can be adjusted to within about 15.24 cm at 1000 m. A 360° continuous slew is preferably used for proper stabilization.

Processing electronics 46, FIG. 2, typically performs the main processing and sensing for robot 10. Processing electronics 42 may accept commands from OCU 26 and causes robot 10 to act appropriately. In one design, processing electronics 46 may include self-awareness sensors 51, e.g., GPS, sensor 250 and orientation sensor 252, processing unit, e.g., CPU 47, for both high level and low level control functions, amplifiers, e.g., amplifiers 53, and various power conditioning and communication components, e.g., power conditioning component 55 and communication component 57, as known to those skilled in the art.

Processing electronics 46 ideally controls the motion of turret 20 via turret drive 22 and the motion of robot 10. Processing electronics 46 also preferably logs mission data, measures/estimates system localization information (e.g., GPS coordinate, vehicle orientation, vehicle dynamics), and the like, and also provides a payload interface that includes both power and communication. Processing electronics 46 may also provide processing power for targeting and/or fire solution calculation. In one design, the processing electronics 46 may integrate with a TALON® 36V power bus and use a TALON® communication component. Processing electronics 46 preferably utilizes PC-104 standard components, e.g., PC-104 stack 73, FIGS. 2 and 5, integrated self-awareness sensors 51, FIG. 2, e.g., GPS receiver 250, orientation sensor 262, gyros 252, 256 and/or 260, motion controller 258 and orientation sensor 267. In one example, PC-104 stack 73 with processing electronics 46 has the following components: interface boards 71, FIG. 5, one or more processors, e.g., CPU 47 and/or 49, e.g., a Diamond Systems Prometheus CPU, Athena CPU, or similar type CPU, a Diamond Systems Emerald 8-port serial interface module, a Diamond Systems HE104 power supply, and motion controller 258, FIG. 2, e.g., GALIL DMC-1220 motion controller board. PC-104 standards are mature and have been used in robotics for over a decade. PC-104 systems offer almost unlimited expansion options, with components such as motion controllers, I/O boards, serial expansion boards, frame grabbers, power supplies, and many others readily available. Another advantage of using PC-104 architecture 73 is that the computer can run a standard operating system, such as Linux or Windows, allowing for far a far more complex and capable software system to be developed than could be achieved on a microcontroller.

The one or more processors, e.g., CPU 47, and/or CPU 49, forms the primary intelligence of robot 10, allowing robot 10 to run several software processes simultaneously, to handle inputs and output, and to perform high level control of system components.

In one example, turret position sensor subsystem 40, FIG. 2, uses motion controller 258, e.g., a DMC-1220 motion controller, (a two axis motion controller) which directly controls the motion of turret 20 and turret drive 22, including low level stabilization. Motion controller 258 interfaces with the motor amplifiers and controls the motors via high speed control loops, discussed in further detail below with reference to FIGS. 8-13. Employing motion controller 258 for low level control significantly offloads the CPU 47 and reduces the design effort.

Figure 14:
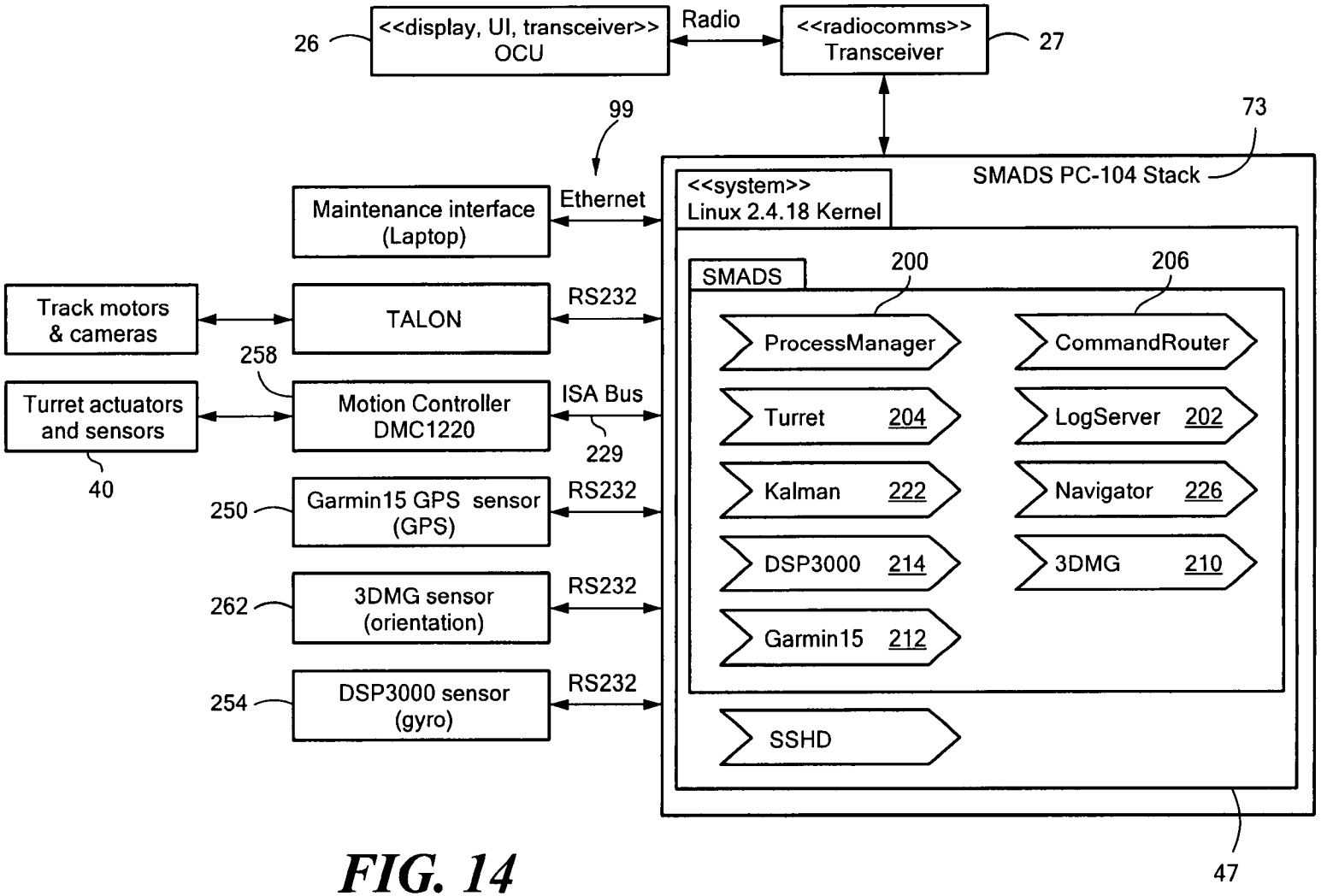
FIG. 14 is a schematic block diagram showing one example of the primary components of the processes utilized by the one or more processors of the processing electronics shown in FIG. 2.

CPU 47, the serial interface, and motion controller 258 preferably communicate over the PC-104 bus, e.g., bus 99, FIG. 14, and provide high speed communication between various components or subsystems 22, 24, 30, 40, 42, 44, 45, 46, FIG. 2. The power supply also uses the bus to deliver power the stack components. See, e.g., FIG. 14, discussed in detail below.

Robot 10 preferably uses power and communication systems, e.g., as disclosed in U.S. patent application Ser. Nos. 11/543,427, cited supra. OCU 26 provides a well known and intuitive interface to the robot. Directional communication subsystem 51, FIG. 1, allows for control of robot 10 at distances approaching one mile. The power bus on the TALON® is robust and can provide sufficient power to run both the vehicle and the turret without straining the system.

Self-awareness sensors 51, FIG. 2, e.g., GPS sensor 250, rate gyros 252, and orientation sensor 262, are preferably integrated to provide robot 10 with an estimate of its location, allowing robot 10 to navigate and point its payload at desired locations. The localization estimate also provides the operator with feedback as to the location of robot 10 in the operational area.

In one example, turret 20 may include two RS-232 ports, four Digital I/O (for trigger actuator, firing circuit, arming circuit, and the like), two analog outputs, and 36V, 2 A current draw.

Figure 6:
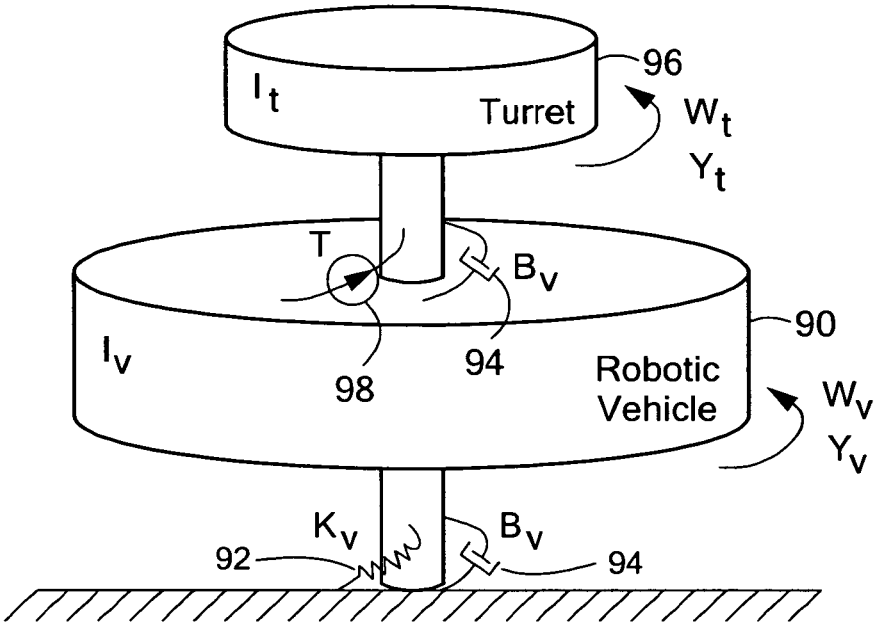
FIG. 6 is a three-dimensional view of a model of inertia of the robot and turret of this invention.

FIG. 6 shows one example of schematic representation of an azimuth stage model of robot 10. The robot is shown as large inertia 90 coupled to the ground through spring 92 and a dashpot 94. These components simulate the ground friction and the flexibility of the vehicle tracks of robot 10. The turret is represented as smaller inertia 96, has full 360° range of motion and therefore only has friction (dashpot) in the link. Linking the two inertias is torque source 98, simulating the turret drive motor.

The equations of motion, in state-space notation, for the simulation shown in FIG. 6 are the following:

$$\begin{Bmatrix} \dot{\psi}_t \\ \dot{\omega}_t \\ \dot{\psi}_v \\ \dot{\omega}_v \end{Bmatrix} = \begin{bmatrix} 0 & 1 & 0 & 0 \\ 0 & -\frac{B_t}{I_t} & 0 & \frac{B_t}{I_t} \\ 0 & 0 & 0 & 1 \\ 0 & \frac{B_t}{I_v} & -\frac{K_v}{I_v} & -\frac{B_t + B_v}{I_v} \end{bmatrix} \begin{Bmatrix} \psi_t \\ \omega_t \\ \psi_v \\ \omega_v \end{Bmatrix} + \begin{Bmatrix} 0 \\ \frac{1}{I_t} \\ 0 \\ -\frac{1}{I_v} \end{Bmatrix} T \tag{1}$$

Equation (1) allows for simulation of the behavior of robot 10 in virtual space. The model may be built in Matlab®/Simulink (www.mathworks.com) and responses to inputs are simulated.

Figure 7:
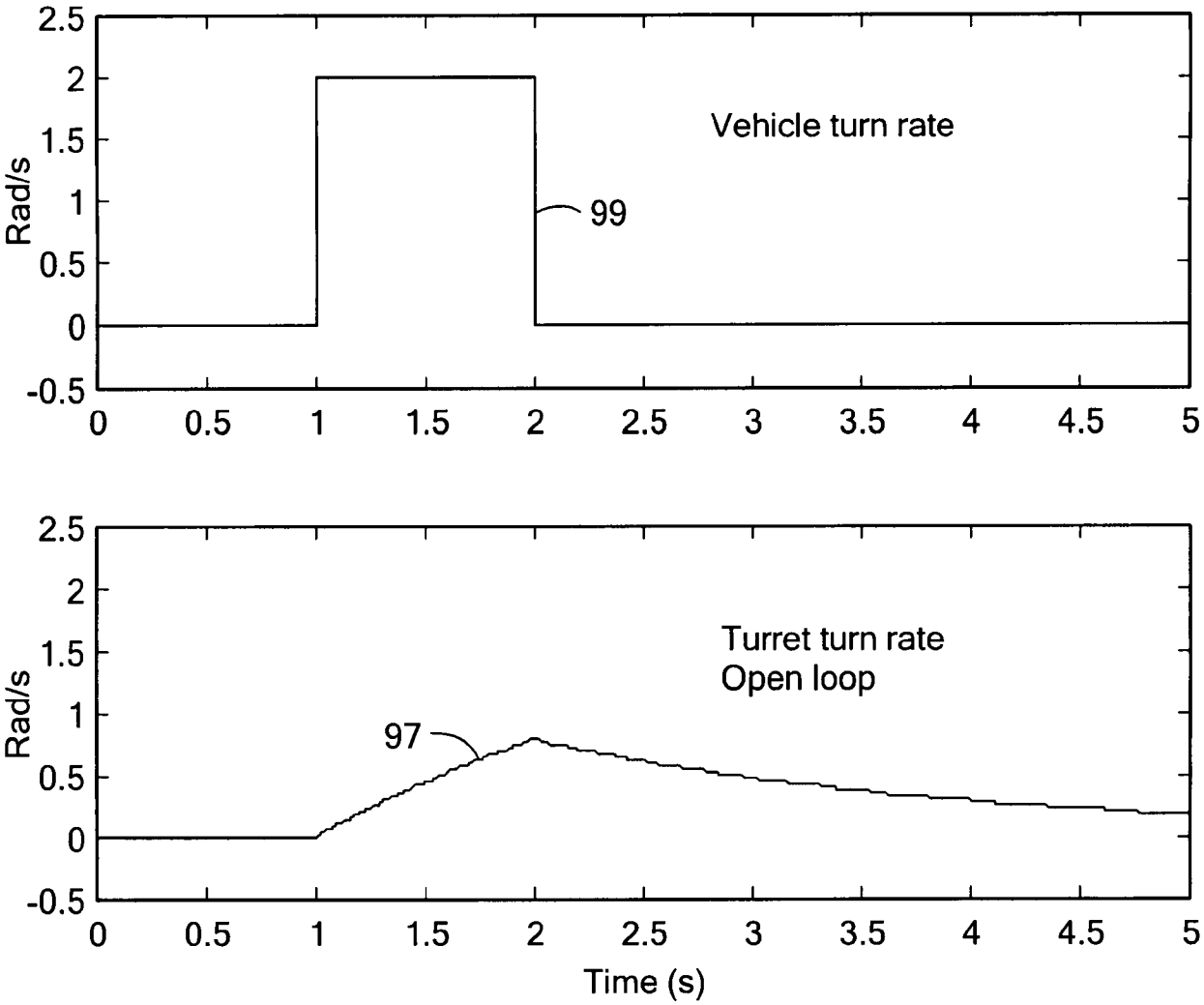
FIG. 7 shows graphs of an open loop response of the model shown in FIG. 6 to a step-up and step-down in vehicle turn rate.

FIG. 7 shows one example of open loop response 97 of the turret to step 99 in robot turn velocity. The turret slowly accelerates due to the friction forces between the turret and the vehicle, and velocity bleeds off slowly when the vehicle stops moving. No torque is applied through the motor.

As shown in FIG. 7, control is required to limit the turret velocity during vehicle maneuvers. A stabilization loop may be implemented which uses rate feedback from the turret mounted gyros to counteract the motion of the turret.

Figure 8:
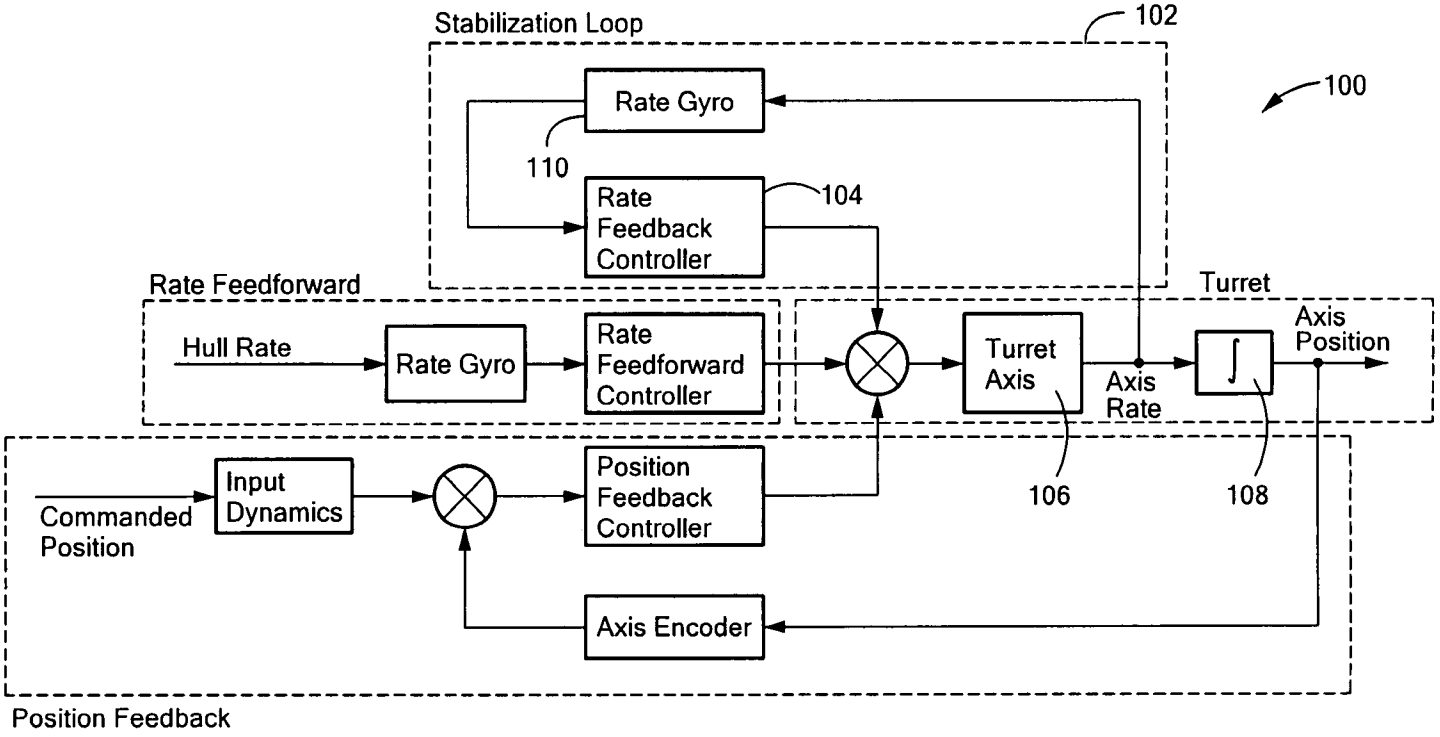
FIG. 8 is a schematic block diagram of one example of the primary components of a control system used for stabilization of robot of this invention.

In one example, turret position and sensor subsystem 40, FIG. 2, may include control system 100, FIG. 8, with stabilization loop 102 having rate feedback controller 104, turret axis 106, integrator 108, and rate gyro 110, which provide stabilization to robot 10.

Figure 9:
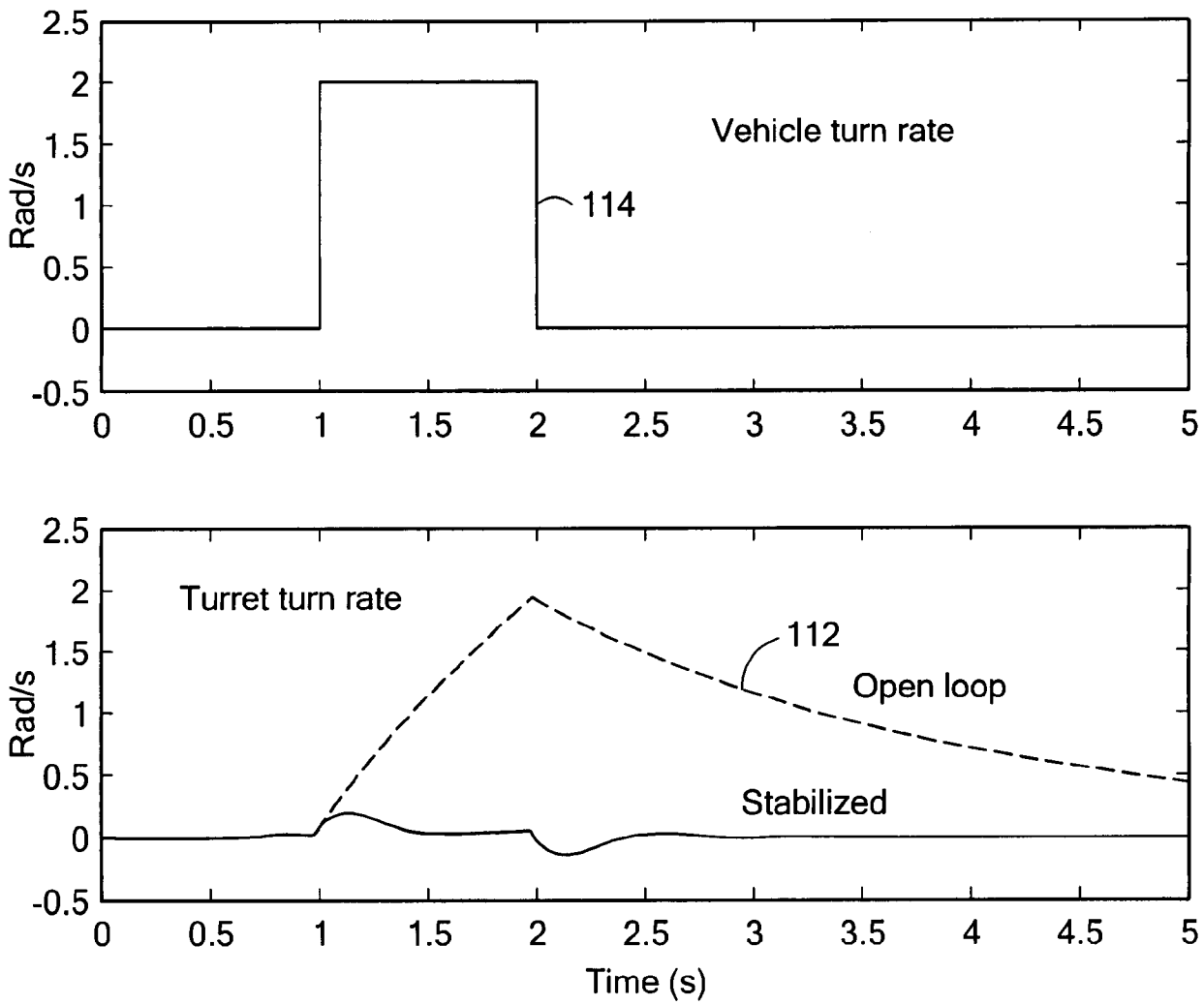
FIG. 9 shows graphs of the stabilized vs. open loop response for the control system shown in FIG. 8.

FIG. 9 shows the improvement in turret response to the robot turn rate step using stabilization loop 102, FIG. 8. As robot 10 accelerates, rate gyro 110 detects a finite velocity of turret, and control system 100 instructs the actuators to counteract the turret motion.

In this example, stabilization loop 102 controls the velocity of turret 20. The rate feedback acts essentially as a low pass filter, damping out higher frequency vibrations, but not affecting the lower frequencies. FIG. 9 shows the improved open loop response 112 to step 114.

Figure 10:
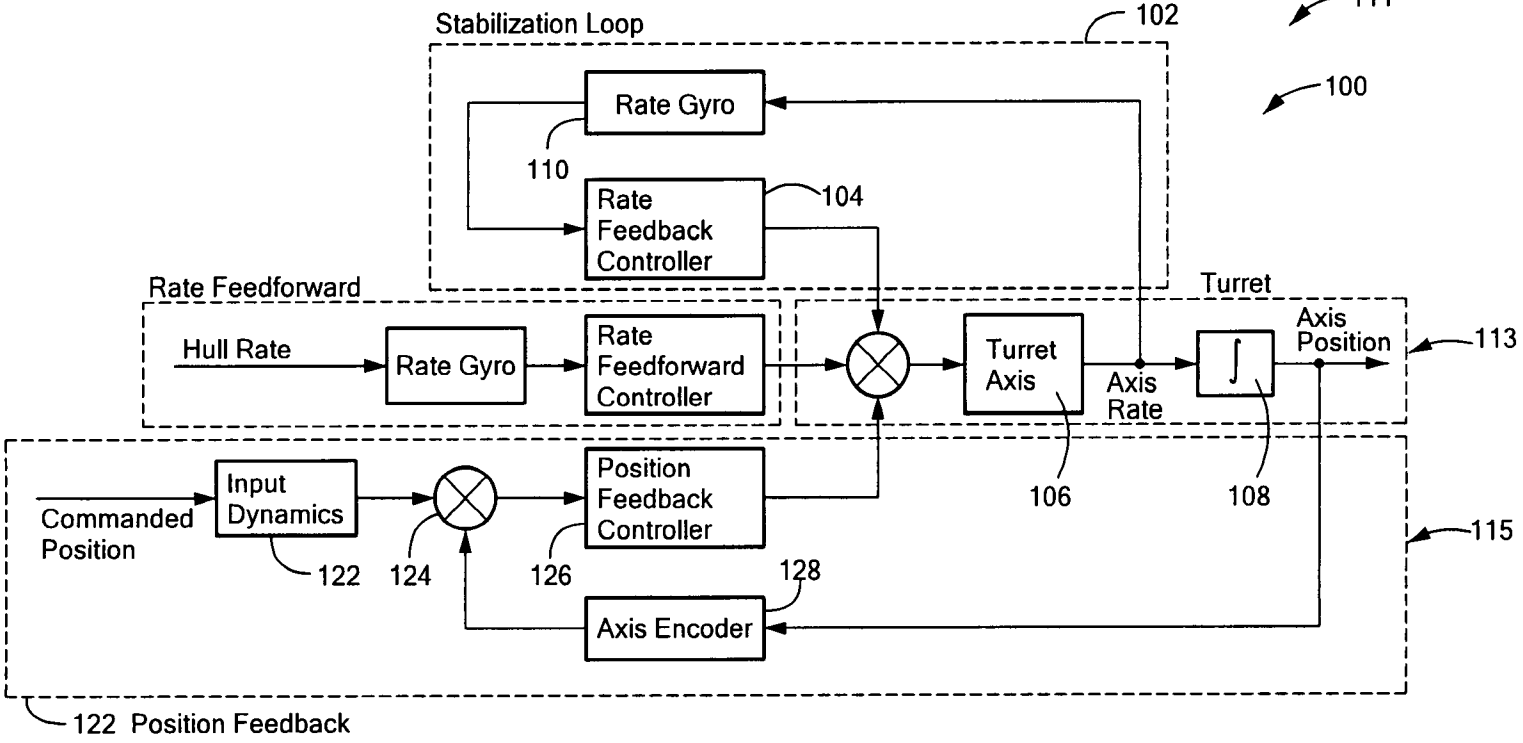
FIG. 10 is a schematic block diagram showing the primary components of the control system shown in FIG. 8 using stabilization and PID position control.

A PID position controller is preferably implemented to give the robot 10 a strong response at low frequencies. Such a controller maintains the pointing direction of the turret, and works in conjunction with the stabilization loop to maintain a steady aimpoint, e.g., at the point of origin of a sound, such as a gunshot. FIG. 10 shows one example of relevant components of control system 100 used to provide a PID position controller for turret position sensor subsystem 40. In this example, the various components in shaded sections 111, 113, and 115 are used. In addition to stabilization loop 102 and turret axis 106 and integrator 108 discussed above with reference to FIG. 8, controller 100, FIG. 10 includes position feedback loop 120 with input dynamics module 122, summer 124, position feedback controller 126, and axis encoder 128 which works together with stabilization loop 102.

Figure 11:
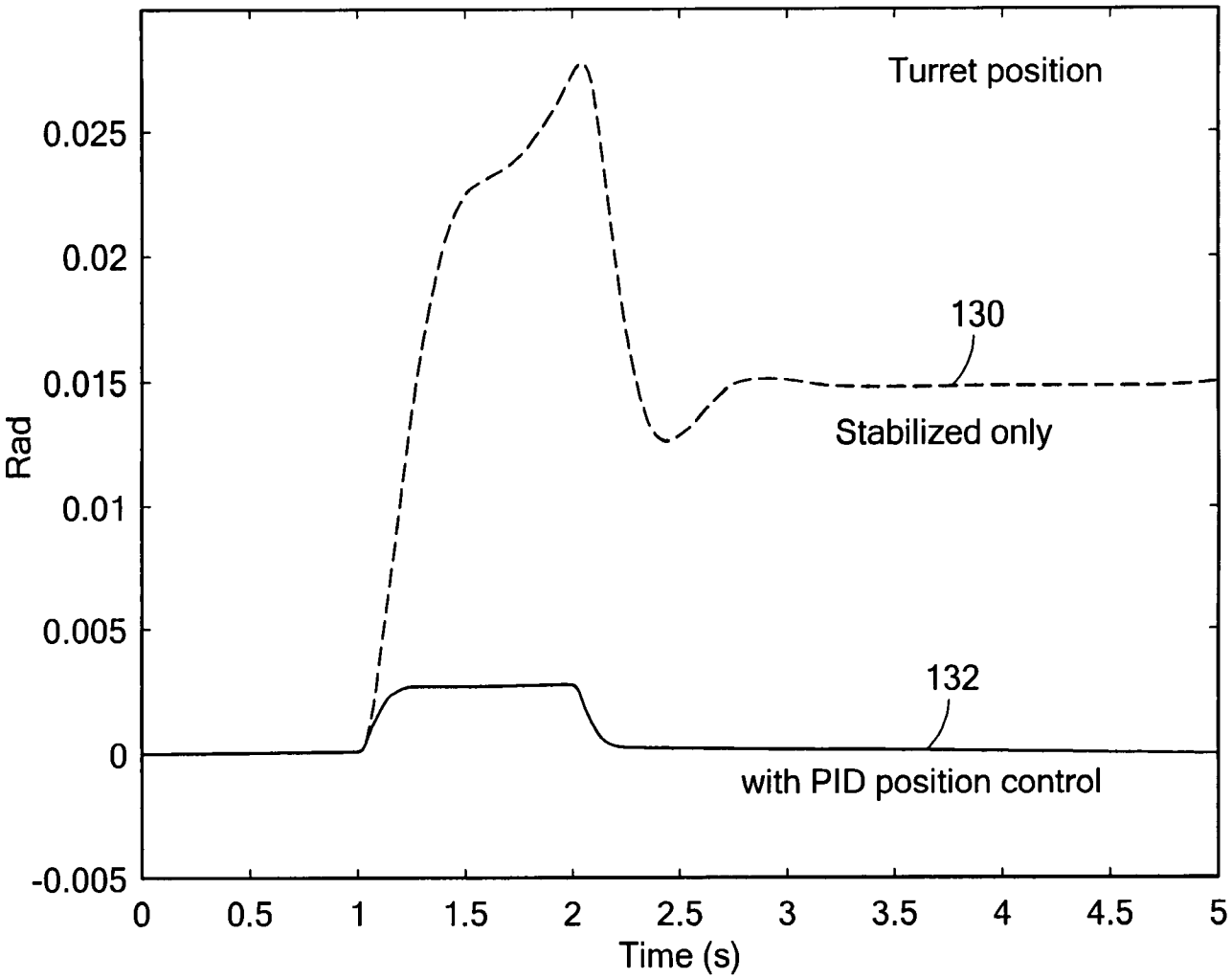
FIG. 11 is a graph showing the comparison of the stabilized and stabilized/PID position control response of the control system shown in FIG. 10.

Position feedback loop 120 of controller 100 significantly improves the response of subsystem 40, FIG. 2 of robot 10. Settling time is decreased, and overall turret velocity is reduced compared to the stabilization-loop-only response. FIG. 11 shows one example of the difference in the position response of the robot 10 to stabilized control system 100, FIG. 8, and stabilized/position control system 100, FIG. 10. Stabilization does not produce any position control, as shown at 130, FIG. 11, whereas the stabilized PID position control maintains a very small pointing error during the vehicle slew and restores the error to zero when the vehicle stops turning, as shown at 132.

Figure 12:
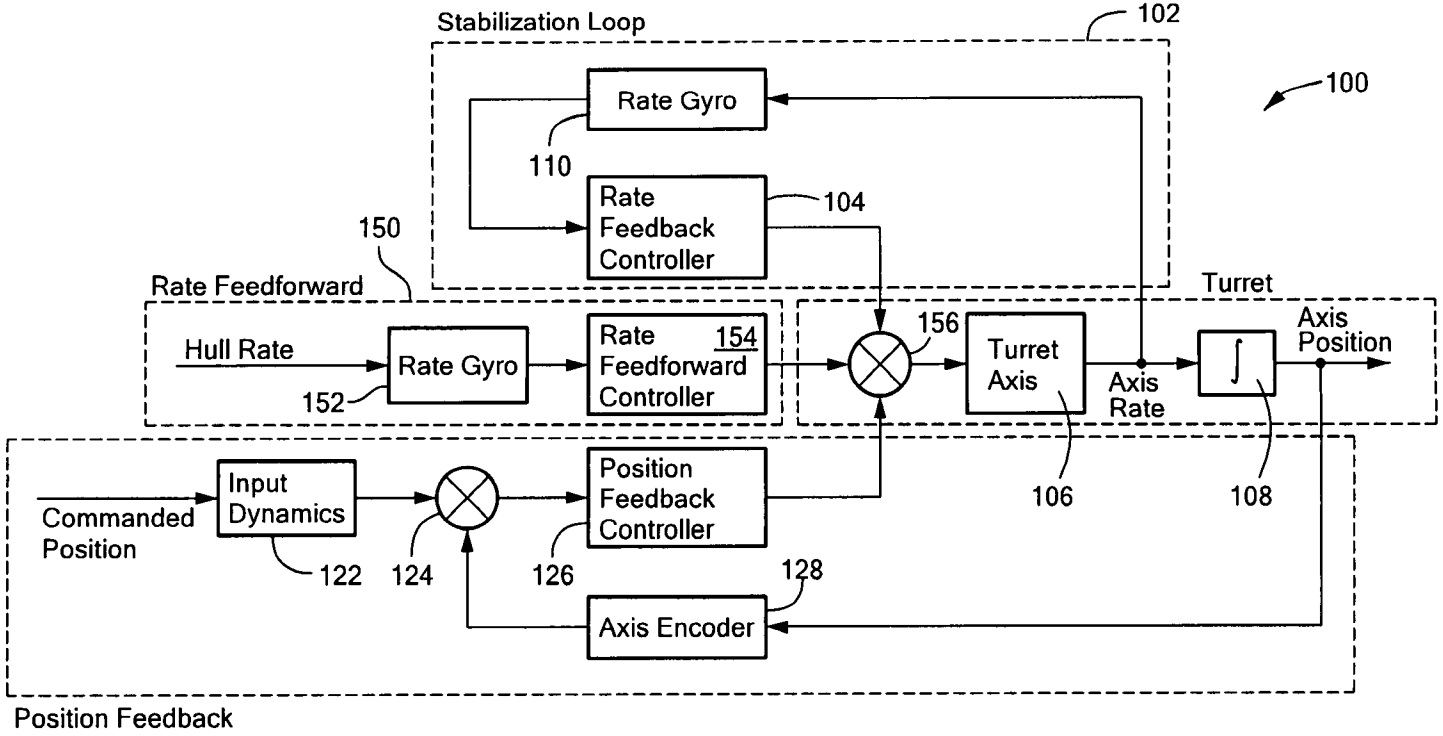
FIG. 12 is a schematic block diagram of one example of a Smart Munitions Area Denial System (SMADS) stabilization/PID controller including a feed-forward controller employed by the robot of this invention.
Figure 13:
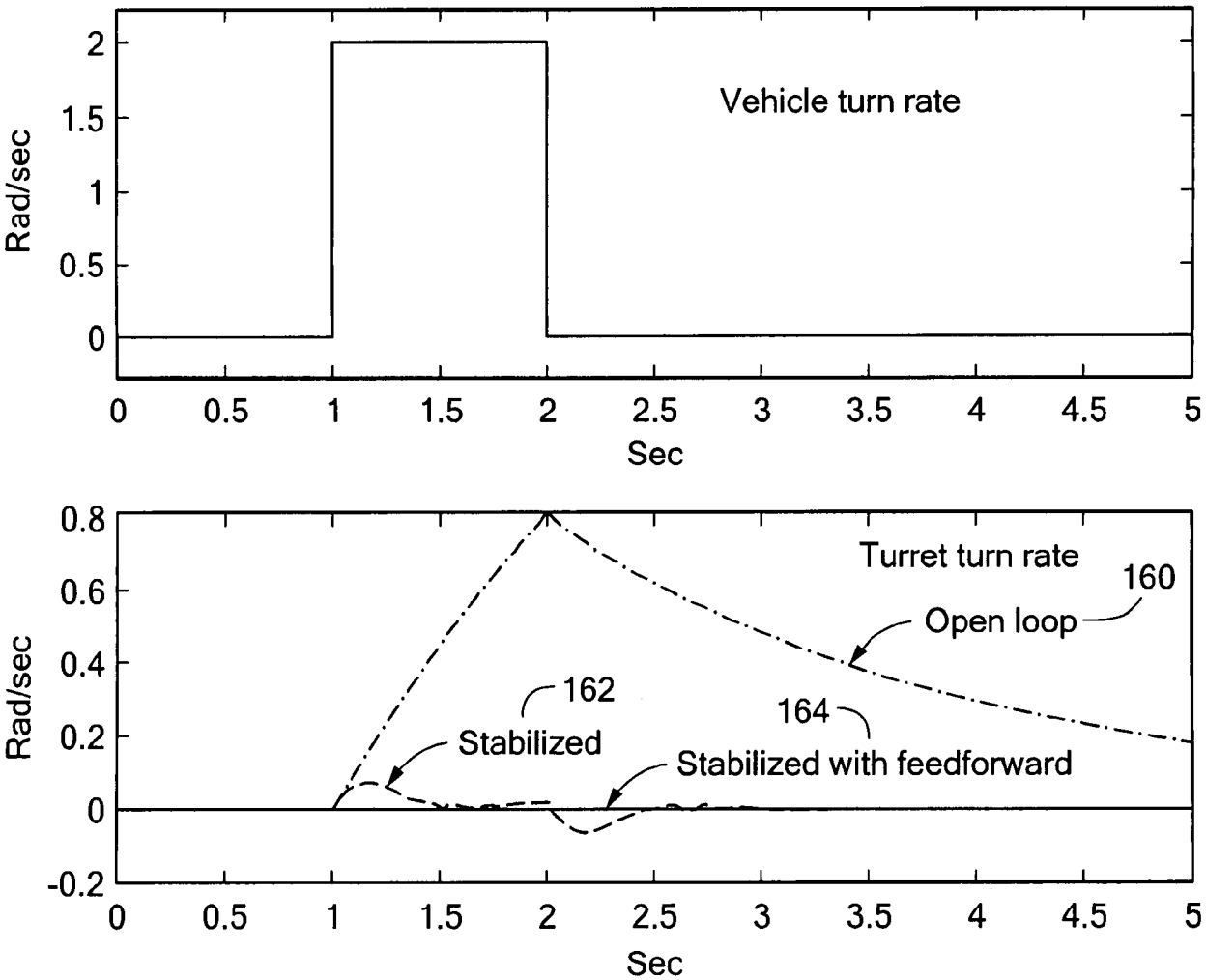
FIG. 13 shows graphs of a response of an azimuth stage to a change in the robot turn rate in accordance with this invention.

In one embodiment, control system 100, FIG. 12, may also include feedforward loop 150 to reduce the effects of vehicle slew induced disturbances. Feedforward loop 150 typically includes rate gyro 152, rate feedforward controller 154, summer 156, turret axis 106, and intergator 108.

By proactively counteracting the effects of a disturbance on robot 10, the effects of the disturbance can be virtually eliminated. If subsystem 40, FIG. 2 with control system 100 reacts to a change detected on the axis sensors, the response is significantly slower. The performance difference between open loop, stabilized without feedforward, and stabilized with feedforward is shown at 160, 162, and 164, FIG. 13, respectively.

The mechanical and electromechanical design of robot 10 preferably uses modeling of the mechanical and servo systems to specify motors and amplifiers that would satisfy the requirements of robot 10. Preferably the servo system is able to accelerate a 1250 lb-in$^2$ payload to 180°/s in 0.2 seconds. Such a rate of change allows for sufficiently rapid motion to allow for stabilization of the payload.

In one example, the azimuth drive motor 78, FIG. 5, and elevation motor 79 for turret drive system 22, may be Kollmorgen AKM22E motors, or similar type motors. The motors can output about 2.5 Nm of torque, which translates to 1750 oz-in when the belt drive reduction is taken into account. Motors 78, 79 ideally are brushless with hall effect feedback for the amplifiers. Motors 78, 79 preferably include encoders 81, 83, FIG. 2, e.g., line count encoders, such as 2000 line count encoders which give 40000 quadrature encoder counts per turret revolution, translating to a position resolution of less than 0.01°. Encoders 81, 83 on turret motors 78, 79 are also a main sensing element. The encoders provide a very accurate measurement (to within 0.01°) of the location of the axes with respect to robot 10. Encoders 81, 83 are preferably the main feedback sensor for the low level motor control performed by the motion controller.

In one example, the motor amplifiers for motors 78, 79 may be Advance Motion Controls (AMC) ZB12A8 brushless motor amplifiers. These amplifiers have a maximum output of 12 A, and well suited for driving the Kollmorgen AKM22E motors utilized in the turret. Commutation is controlled by the amplifier using hall effect measurements from the motors. The amplifiers convert a +/−10V control signal from the motion controller and to a current proportional to this input signal.

Robot 10 typically includes a large number of sensors, e.g., as shown in FIGS. 2 and 14 used for motion control and localization, e.g., precision geo-location, and measurement of vehicle dynamic behavior. The sensors may include GPS receiver 250, FIG. 2, e.g., a Garmin® 15H GPS receiver such as a miniature WAAS (Wide Area Augmentation System) GPS receiver. GPS receiver 250 may be used to provide an absolute measurement of the geolocation of robot 10. Robot 10 may include rate gyros 252, e.g., Systron & Donner QRS14 single axis gyros, which helps stabilization of the payload. In one example, robot 10 senses the motion of the vehicle via a vehicle gyro 256. Gyros 256 preferably measure the roll, pitch, and yaw of the vehicle and has a range of +/−20°/s, sufficient to capture typical vehicle motion (approximately 100°/s max). The signals from gyro 256 are read by motion controller 258. In response, motion controller 258 attempts to counteract this motion by driving the turret 20 axis appropriately. Gyros 256 may be considered feedforward sensors. Processing electronics 46 may also include single axis feedback gyros 260, e.g., Systron & Donner SGP50 3-axis rate gyros. Gyros 260 are preferably high precision gyros that measure the motion of the payload. Since the feedforward control of the turret is never exactly correct, the payload may experience some motion due to vehicle motion. This motion is detected by the payload gyros, and controllers corrects for any detected motion of the payload. These sensors may be considered feedback sensors. The feedback gyros have a range of +/−500°/s, allowing them to capture very high rates of payload motion.

In one example, robot 10 may employ fiber optics gyro 254, e.g., a KVH DSP-3000 fiber optic gyro to improve low rate stabilization performance.

In one design, robot 10 may include orientation sensor 262, e.g., a 3DM-G orientation sensor to provide an absolute measurement of the orientation of robot 10 in space. Orientation sensor 262 typically consists of 3 gyros, 3 accelerometers, and 3 magnetometers. The outputs of the three sensor sets are fused onboard sensor 262 to provide an estimate of the true orientation of robot 10 in space. Orientation sensor 262 works through the entire 360° range of orientations and has an accuracy of 5°.

Motion controller 258, FIG. 2, preferably performs the low level control of turret 20, and turret drive 22. In one preferred design, motion controller 258 performs low level motion control, sets the tuning parameters for motors 78, 79, FIGS. 2 and 5, receives feedback from analog gyros and stabilize the turret, and receives high level motion input, e.g., turret velocity or position.

The software architecture used for robot 10 is preferably a multi-process architecture running on Linux windows, or similar type platform. Each process running on the robot 10 is responsible for a logical task, e.g., turret control, radio communications, vehicle communication and control, localization process, navigation, payload control, and sensor drivers, and the like.

FIG. 14 shows one example of the hardware/software configuration of the various components of PC-104 stack 73, FIGS. 2 and 5, of robot 10, FIG. 2. In this example, the architecture includes ProcessManager 200, FIG. 14, LogServer 202, Turret Component 204, and CommandRouter 206. CommandRouter 206 handles receiving commands from OCU 26 (also shown in FIG. 2), parsing, from stream 27, e.g., the SMADS specific and TALON® generic data, resulting in the commands being executed by Turret component 204, e.g., SMADS specific commands. CommandRouter 206 also handles communication in the reverse direction, receiving, e.g., TALON® status messages and relaying them off to the OCU.

Turret component 204 typically handles all the control details for the turret 20 and turret drive 22 and also provides turret state information to any other system component. In practice this means that the turret component 204 handles all communications to a motion controller 258, e.g., DMC1220 motion controller, (or similar type motion control) that is to be used for controlling the servo motors 78, 79, FIGS. 2 and 5.

LogServer 202, FIG. 14, component is typically available as a centralized system logging facility that all other components may use to record log messages. LogServer 202 also provides a way to provide remote monitoring of robot 10. A developer or support engineer can establish a telnet session on a designated port that has been assigned to LogServer 202, e.g., on the PC104 stack 73, FIGS. 2 and 5. LogServer 202, listening on this port for connections, will accept the connection which will then be used to relay all subsequent log messages to the client while the connection is maintained.

ProcessManager 200 preferably launches all the other system components shown in FIG. 14 and controls and monitors their execution state. Any logic for handling component error conditions or failure management should be put here.

In one example, 3DMG orientation process 210, Garmin 15 GPS process 212, and DSP3000 gyro process 214 gather information from orientation 3DMG sensor 262, Garmin 15 GPS receiver 250, and DSP300 gyro sensor 254, respectively.

KalmanFilter process 222, FIG. 14, gathers information from various onboard sensors shown in FIGS. 2 and 14 and performs the sensor fusion on these measurements to estimate the vehicle state, e.g., location, orientation, velocity, and the like.

Navigator component 226, FIG. 14, is preferably responsible for autonomous navigation of robot 10. Navigator component 226 communicates with the Kalman filter process 222 to determine the location and orientation of the vehicle, calculates appropriate vehicle commands, and sends these commands to CommandRouter 206, which instructs robot 10 to perform the desired motions.

In order to minimize the burden on CPU 47, FIGS. 2 and 14, and/or the bus of PC-104 stack 73, the majority of motion control functions are preferably conducted on the motion controller 258. Depending on the mode of operation, either joystick commands or desired turret location, relative to the vehicle, are passed to the motion controller 258. Motion controller 258 then takes care of moving the axes according to the user commands or stabilization method.

Motion controller 258 typically receives a command from CPU 47 indicating which motion mode the system is in. The possible motion modes of operation may include: 1) fully manual: no automatic motion control is conducted and turret 20 simply follows the joystick commands from the operator, 2) gyro stabilized: turret 20 maintains the payload pointed along a vector in space, relying on the gyros to detect motion of the payload and counteracting these motions through appropriate motor commands, or 3) stabilized about a GPS target location: the payload is kept pointed at a location in space, designated as a GPS coordinate. As the robot 10 moves, the payload pointing direction is updated to maintain the aimpoint, as robot 10 moves, e.g., a discussed above with reference to FIG. 1.

In fully manual mode, turret motors 78, 79, FIGS. 2 and 5, are moved at a speed proportional to the joystick command received from OCU 26. Therefore, if the joystick is in a neutral position, the turret motors will not move, and the payload pointing direction will move as the vehicle moves.

In gyro stabilized mode, turret 78, 79 motors will counteract the motion of robot 10. The joystick commands passed to the motion controller indicate the rate at which the turret should move in absolute space. Therefore, if the joystick is neutral, the turret will attempt to remain pointed in a given direction even if the vehicle is moving. A joystick command will move the turret relative to the global coordinate system, regardless of the vehicle dynamics.

Targeting refers to the ability of system to "focus" the turret or a user defined target or on the origin of the noise or gunshot, e.g., O-13, FIG. 1. As robot 10 moves, turret 20 will update its position to maintain its pointing direction in the direction of the target. The operator can therefore monitor the target without having to manually track the target from the user interface. One primary objective of robot 10 is to offload the operator from low level system tasks, allowing him concentrate on higher level mission tasks, such as asset allocation and combat strategy. Such offloading allows one operator to control multiple vehicles simultaneously.

In one example, the targeting system 45, FIG. 2, is implemented on one or more processors, e.g., CPU 47 of PC-104 stack 73, FIGS. 2 and 14. Several processes run concurrently on CPU 47, e.g., monitoring communication with a base station, running the localization filter, managing sensors, and controlling the turret. The targeting algorithm may reside in the turret component 204, FIG. 14, of the software, but works closely with the localization filter and user interface components.

Turret component 204 is constantly being updated by the localization process and the command router 206 as to the location and orientation of the robot 10 and the desired target point, respectively. Using these two pieces of information, robot 10 can calculate the desired position of the two turret axes, as described below.

When stabilized about a target location, orientation sensor 262, FIGS. 2 and 14, is brought into the control loop to maintain to absolute pointing direction of turret 20. CPU 47 preferably uses the orientation sensor data from orientation sensor 262 to calculate the desired relative position of turret 20 required to point the payload in a certain heading and at a certain elevation, e.g., the location of the origin of a sound, e.g., O-13, FIG. 1. The relative position is defined in encoder counts, and these encoder counts are sent to motion controller 258, FIGS. 2 and 14. In GPS target stabilized mode the geolocation of robot 10 and the target are used to calculate the pointing vector of the turret 20. The desired turret relative position, e.g., in encoder counts of encoders 81, 83, FIG. 2, is passed to turret 20 and turret drive 22, which treats the encoder counts as when in heading/elevation stabilization mode.

The gains on the encoder count error are preferably set fairly low to ensure smooth operation. Over short time intervals, the gyros, e.g., gyros 252, 254, and/or 260, FIG. 2, will keep turret 20 pointed appropriately, and the low gain on the encoder count error simply ensures that over long periods of time, the pointing direction is maintained. If the gain were too high, any noise or temporary disturbances in orientation sensor 262 would manifest themselves in the turret motion.

The user can change the stabilization mode mid-mission as needed. For example, the user can switch to fully manual mode from GPS stabilized when the user needs to fine-aim the weapon or payload, and resume stabilization when firing or payload actuation is complete.

In one example, motion controller 258 may be a DMC1220 motion controller designed for a dedicated motion control DSP and is specifically designed to handle low level control functions. Functions such as position control or velocity control are very easily implemented.

Due to the simplicity of velocity and position control implementation on the motion controller 258, robot 10 leverages these functions to eliminate the need for CPU 47 to perform low level motion control. In one example, motion controller 258 can accept up to 8 analog inputs, sufficient for both rate feedback and vehicle rate feedforward. Motion controller 258 also interfaces with the servo motor encoders, reducing the amount of required hardware development.

In one example, velocity of the motors 78, 79, FIGS. 2 and 5, may be directly specified and the motion controller will perform the low level control functions necessary to achieve the specified velocity.

Figure 15:
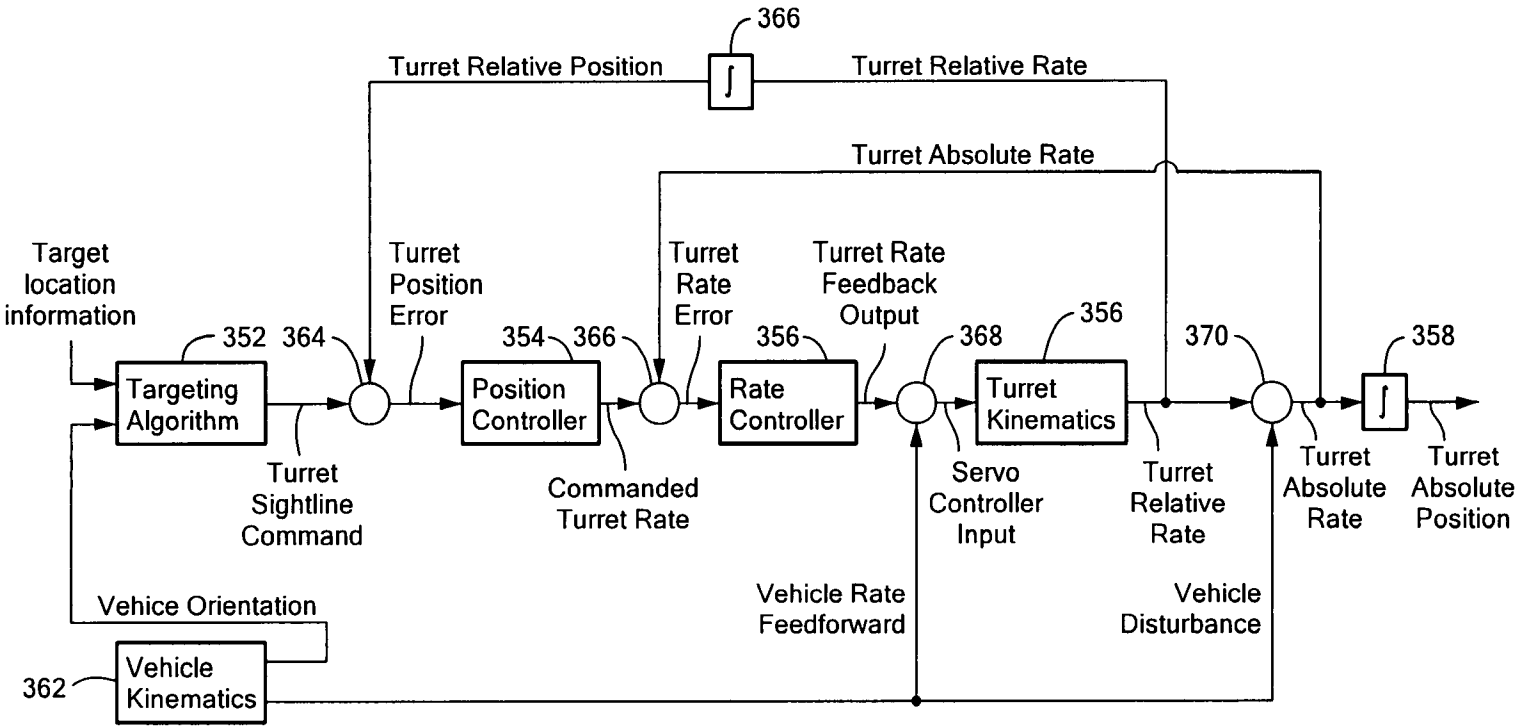
FIG. 15 is a schematic block diagram showing another example of a control system used for motion control of the robot in accordance with this invention.

FIG. 15 shows a block diagram of one example of control system 350 of robot 10. In this example, control system 350 includes targeting algorithm 352, position controller 354, rate controller 356, turret kinematics 356, integrators 358 and 360, vehicle kinematics 362, and summers 364, 366, 368, and 370. Control system 350 is preferably a SMADS feedback/feedforward control system and is preferably designed for use with motion controller 258, e.g., a GALIL-DMC 1220. The method in which the hull rate feedforward is handled brings control system 350 inline with standard turret control systems. By removing the need to perform very low-level control functions on CPU 47, FIG. 2, and assigning them to motion controller 258, the system and control development of robot 10 is simplified.

The following are advantages of control system 350 lower computational burden on CPU 47, allowing CPU 47 to service other tasks in a more timely manner, simplified implementation since low level control methods are available onboard motion controller 258, FIGS. 2 and 14. Velocity control by motion controller 258 makes robot 10 less sensitive to configuration changes. Motion controller 258 simply needs to be retuned when a new payload in integrated, rather than needing to change the entire system model around. CPU 47 does not always need to run real-time operating system, saving development time and computational power.

The feedforward stabilization and control system 350, FIG. 15, measures the motion of the mobility platform and drives turret 20 to counter the movement of robot 10. The desired turret 20 elevation motion is calculated using the following trigonometric relation between the gyro output, the turret location, and the turret motion:

$$\dot{\theta}_{elev}=C\dot{\theta}_{1,fw}\sin(\psi)+C\dot{\theta}_{2,fw}\cos(\psi) \quad (2)$$

where $\dot{\theta}_{elev}$ is the commanded elevation rate, $\dot{\theta}_{1,fw}$ and $\dot{\theta}_{2,fw}$ are the roll and pitch rates of robot 10, respectively, and $\psi$ is the azimuth location of turret 20 with respect to the forward direction. Therefore, if turret 20 is pointed forward, robot 10 will cause little or no movement of the elevation axis, while pitching motion will be entirely counteracted. If turret 20 is pointed to the side, the roll behavior will be counteracted, but not the pitch behavior. Roll and pitch will be both counteracted if turret 20 is off-axis (i.e. not exactly forward or exactly to the side). This feedforward stabilization algorithms works well for small angle deviations.

Preferably, CPU 47, FIG. 2, parses command string from OCU 26, FIGS. 2 and 14, and, in one example, uses the four key values from that string. In one example, the four values are passed to motion controller 258 as the following variables: JXCMD (azimuth joystick command), JYCMD (elevation joystick command), STABMODE (stabilization mode toggle), JSCALE (speed scale factor), AZDES (desired azimuth), and ELDES (desired elevation).

These variables are used by controller 258 software to specify the behavior of turret 20. As these variables are updated, turret 20 reacts appropriately. As more capability is added, additional data can sent to the motion controller in a similar manner.

Dual axis stabilization may be implemented. The feedforward loop shown in FIG. 15 preferably uses a 3-axis gyro 256, FIG. 2, mounted to robot 10 to measure the motion of the vehicle, allowing turret 20 to counteract that motion. A feedback loop measures the motion of the turret itself using a turret mounted single axis gyro, correcting for any motion not eliminated by the feedforward loop.

When in stabilized mode, turret 20 and robot 10 act essentially independently. Turret 20 will slew at the desired rate in the global reference regardless of the vehicle slew rate and robot 10.

To avoid noise issues associated with feedback gyros and the drift in the horizontal feedforward gyros, the stabilization algorithm was reduced to simply azimuth feedforward. This provides the most useful stabilization performance since the drift is reduced significantly and the noise in the feedback gyros is eliminated from the control loop.

In one embodiment, fiber optic gyro 254, FIG. 2, may be a KVH DSP3000 fiber-optic gyro. This stabilizes the turret at low speeds, e.g., (<5°/s). Analog gyros may be used for higher speeds. This implementation was chosen because the delays associated with processing and sending the DSP3000 sensor 254, FIG. 14, data to the motion controller 258 were causing large lags in the turret at high speeds. Since the analog gyro is fed straight into the motion controller 258, delays are nearly eliminated, improving high speed performance significantly.

One approach to calculating the turret pointing direction begins by determining the vector, P, from robot 10 to the target. Both the target and robot 10 location are preferably given in a NED coordinate system. The pointing vector is calculated as, $$P = \begin{Bmatrix} X_t - X_v \\ Y_t - Y_v \\ Y_t - Y_v \end{Bmatrix}. \tag{3}$$

Once the P vector is known, it is transformed from the NED coordinate system to the vehicle coordinate system. Once the vector is known in vehicle coordinates, the turret angles required to achieve the P-designated pointing direction are found using simple trigonometry.

The localization Kalman filter provides vehicle pitch/roll/yaw information. Pitch, roll, and yaw are preferably transformed to a 3×3 orientation (or transformation) matrix by the turret component. The transformation matrix is used to transform a vector from one reference frame to another, without changing the vector location or orientation in space.

The transformation matrix output, $M_{3DM\text{-}G}^{NED,actual}$, is used to define the P vector in vehicle coordinates:

$$P' = M_{3DM\text{-}G}^{NED,actual} P \tag{4}$$

Once the P' vector is known (i.e. the vector pointing to the target defined in the vehicle reference frame), the vector must be mapped to turret coordinates. The commanded (desired) azimuth angle (AZDEZ) is calculated as:

$$AZDES = \tan^{-1}\left(\frac{P'(2)}{P'(1)}\right) \tag{5}$$

And commanded (desired) elevation angle (ELDES) is calculated as, $$ELDES = \tan^{-1}\left(\frac{P'(3)}{(P'(2)^2 + P'(1)^2)^{\frac{1}{2}}}\right) \tag{6}$$

The two values are passed to the turret motion controller 258, FIGS. 2 and 14, as degrees, e.g., −180°–>180°. Motion controller 258 is preferably responsible for ensuring that turret 22 takes the shortest path to the target location. In other words, if the commanded azimuth direction changes from −179° to 179°, the turret should move 2° CCW, not 358° CW. In short, if the system observes a turret pointing direction change of over 180° in one control loop cycle, it is assumed that the −180° to 180° transition occurred, and the appropriate correction is applied.

Figure 16:
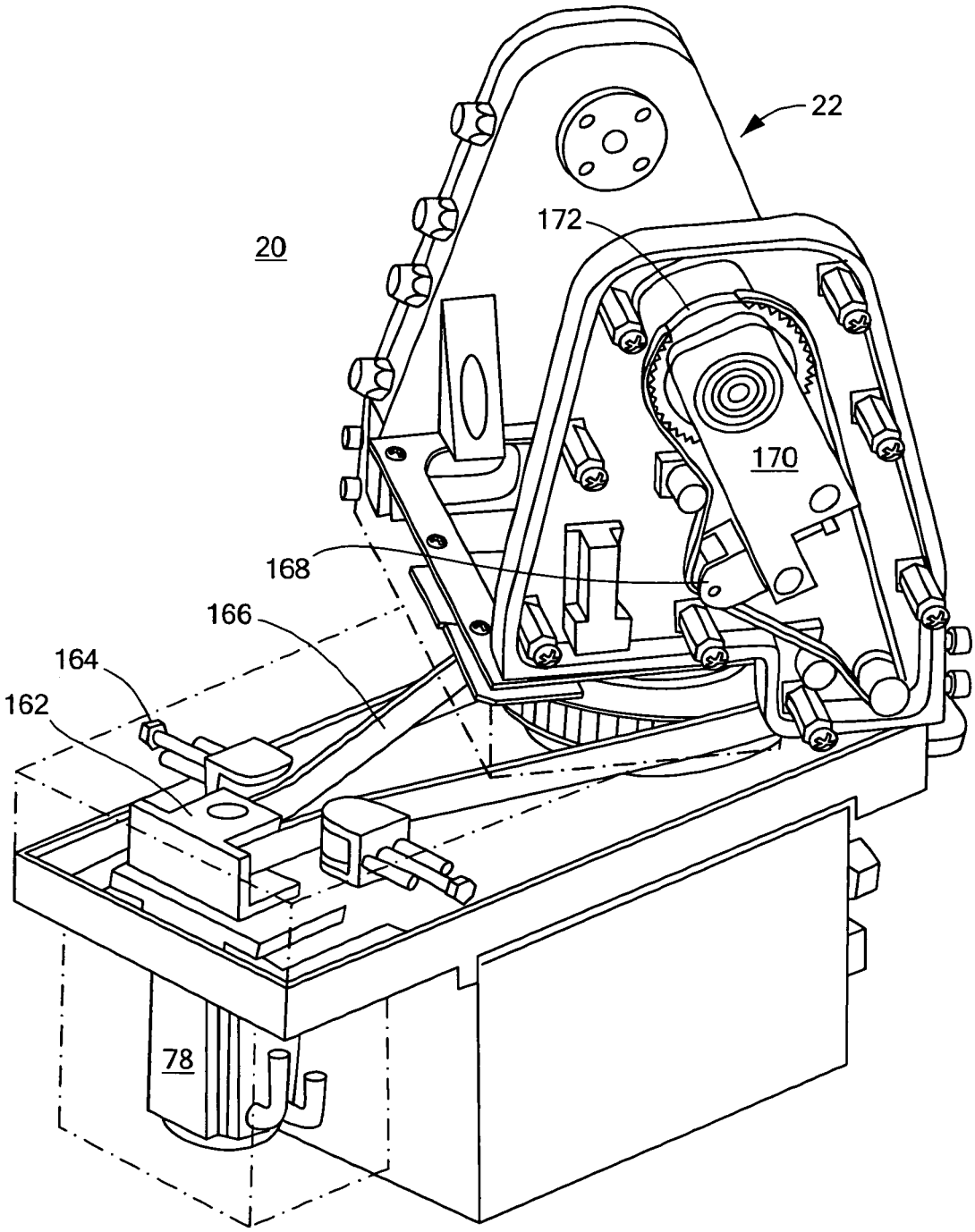
FIG. 16 is a three-dimensional front view showing the primary components of one embodiment of the turret and turret drive system shown in FIGS. 2-5.

FIG. 16 shows one example of turret 20 with turret drive 22 typically mounted on robot 10 of this invention. In this example, turret drive 22 includes azimuth drive motor 78, azimuth drive pivot assembly 162, azimuth belt tensioner 164, azimuth belt drive 166, elevation belt tensioner 168, bearing assembly 170 and elevation belt drive 172. Belt drives are preferably to maintain low noise emission and reduce weight.

Figure 17:
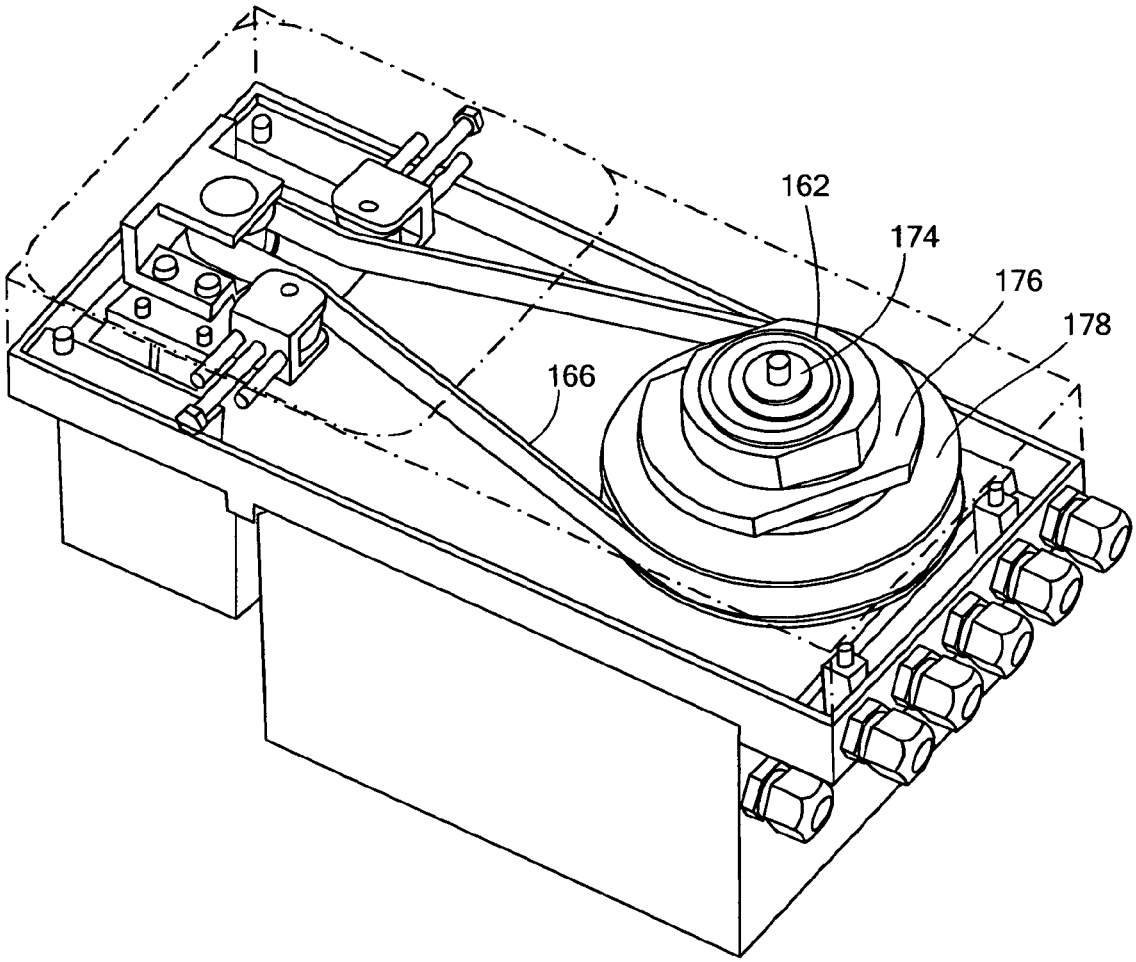
FIG. 17 is a three-dimensional top view showing in further detail the azimuth access and the location of the slipring and mounting plate shown in FIG. 16.

FIG. 17 shows in further detail one example of pivot assembly 162 with slipring 174, elevation attach plate 176, drive pulley 178, and belt 160.

Figure 18:
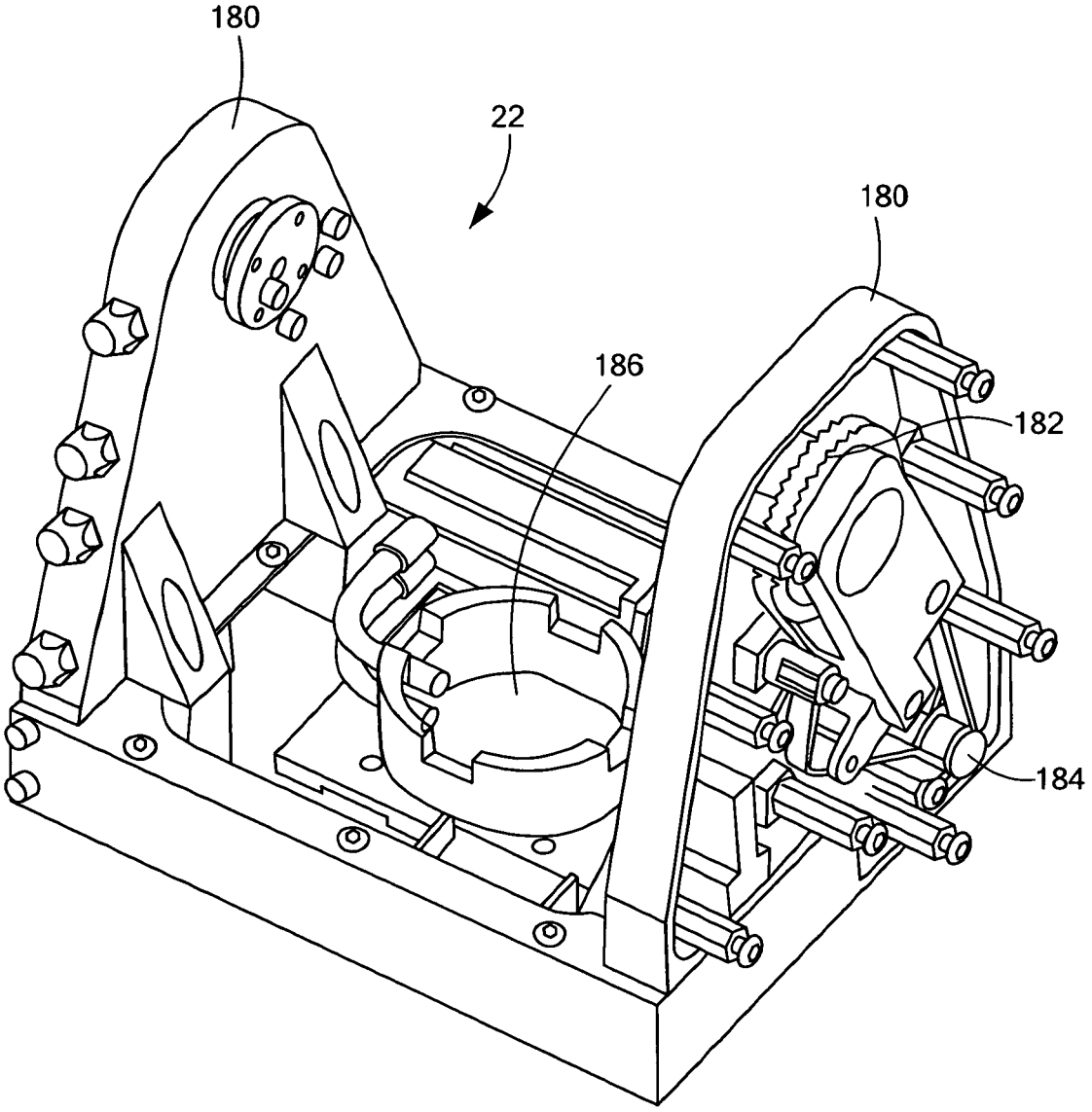
FIG. 18 is a three-dimensional view showing in further detail one example of the elevation stage of the turret drive shown in FIG. 16.
Figure 19:
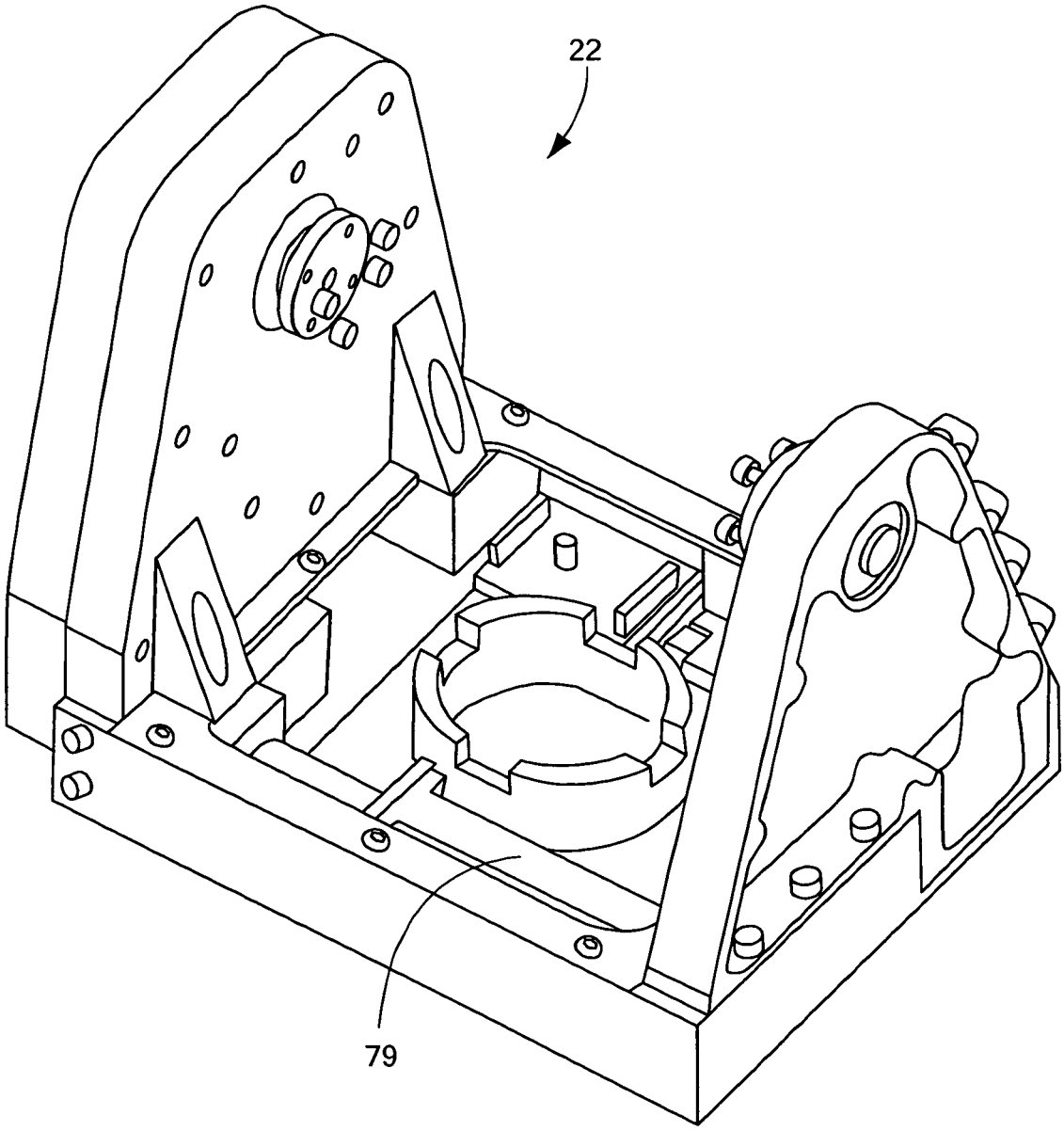
FIG. 19 is a three-dimensional front view showing in further detail the elevation stage and the location of the elevation motor shown in FIG. 16.

FIG. 18 shows in further detail turret drive 22 with elevation posts 180, elevation drive pulley 182, pinion pulley 184, and pivot attachment 186. Turret drive 22 preferably includes elevation motor 79, FIG. 19.

Figure 20:
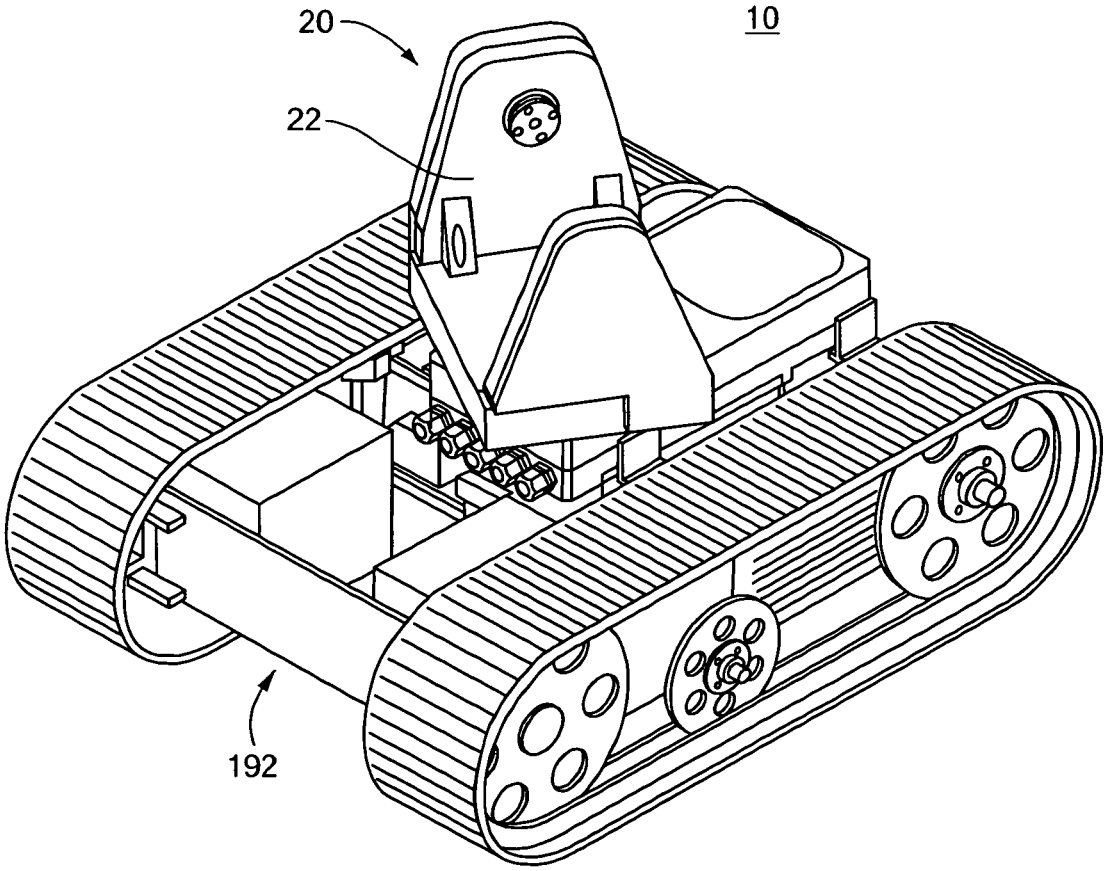
FIG. 20 is a three-dimensional front view showing the turret shown in FIGS. 2-5 and 16-19 mounted to a TALON® vehicle in accordance with this invention.

FIG. 20 shows another example of robot 10 having turret 20, e.g., a SMADS turret, and turret drive 22 mounted on a TALON® vehicle 192, e.g., as disclosed in U.S. patent application Ser. No. 11/543,427 cited supra.

Figure 21:
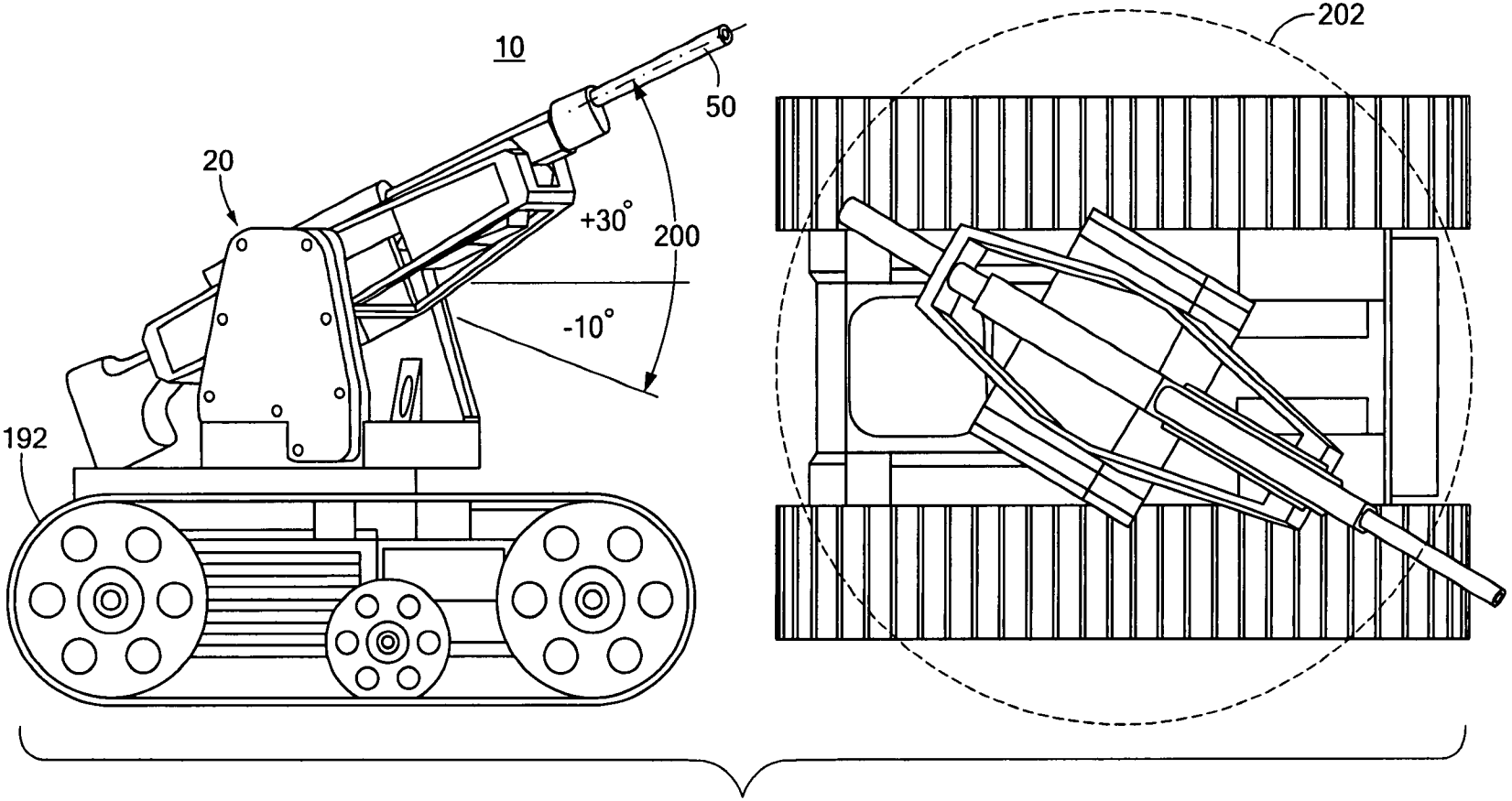
FIG. 21 is a schematic side view showing one example of a weapon mounted to the turret of the robot of this invention and showing the nominal payload excursion in elevation and continuous azimuth rotation.

FIG. 21 shows one example of robot 10 having turret 20 and with turret drive 22 mounted on a TALON® vehicle 112. In this example, the fully assembled robot 10 is about 33" long, 25" wide, and 22" high, and provides a payload (e.g., weapon 50) excursion of about +30°/−10°, in elevation, indicated at 200 and a 360° continuous in azimuth, indicated at 207. However, as long as the weight and inertia constraints are observed, there is no physical or dynamic reason that the payload length could not be extended indefinitely.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A mobile, remotely controlled robot comprising:

a robot drive subsystem for maneuvering the robot via wireless signals transmitted from an operator control unit;

a robot position and movement sensor subsystem configured to determine the position of the robot;

a turret on the robot with a weapon mounted thereon, the turret including a turret motor controller with an elevation drive and an azimuth drive;

a weapon fire control subsystem for firing the weapon based on a signal received from the operator control unit;

a turret position sensor subsystem configured to determine an aiming direction of the weapon;

a gunshot detection subsystem configured to detect a gunshot original location; and a processing electronics subsystem responsive to said wireless signals transmitted from the operator control unit, the determined position of the robot, the aiming direction of the weapon, and the gunshot original location and configured, in a coordinate stabilization mode, to:

control the elevation drive and azimuth drive to aim the weapon at the gunshot origin location based on the determined position of the robot, the aiming direction of the weapon, and the gunshot origin location, maneuver the robot via the robot drive subsystem in accordance with said wireless signals transmitted from the operator control unit, and control the elevation drive and azimuth drive to change the elevation and aiming direction of the weapon to maintain the aim of the weapon at said gunshot origin location as the robot maneuvers.

2. The robot of claim 1 in which the processing electronics subsystem is further configured to control the elevation drive and azimuth drive in a stabilization mode and a heading/elevation stabilization mode and/or a gyro stabilization mode.

3. The robot of claim 2 in which the processing electronics subsystem is further configured for a manual mode to control the elevation drive and azimuth drive according to wireless signals transmitted from the operator control unit.

4. The robot of claim 1 further including a stabilization loop configured to limit turret velocity during robot maneuvering.

5. The robot of claim 1 in which said processing electronics subsystem is configured to calculate a pointing vector from the robot to the gunshot origin location, to transfer the pointing vector to a robot coordinate system, and to map said transferred vector to turret coordinates to compute a desired azimuth angle and desired elevation angle output to said turret motor controller.

6. The robot of claim 5 in which said turret motor controller is configured to control the elevation drive and azimuth drive to aim the weapon at said gunshot origin location using a shortest path.

7. The robot of claim 1 in which the robot position and movement sensor subsystem includes a GPS receiver and motion sensors.

8. The robot of claim 1 in which the turret position sensor subsystem includes encoders.

* * * * *